US007924257B2

(12) United States Patent
Hashimoto

(10) Patent No.: US 7,924,257 B2
(45) Date of Patent: Apr. 12, 2011

(54) DISPLAY DEVICE, DRIVER CIRCUIT THEREFOR, AND METHOD OF DRIVING SAME

(75) Inventor: Yoshiharu Hashimoto, Kanagawa (JP)

(73) Assignee: Renesas Electronics Corporation, Kanagawa (JP)

( * ) Notice: Subject to any disclaimer, the term of this patent is extended or adjusted under 35 U.S.C. 154(b) by 726 days.

(21) Appl. No.: 11/984,354

(22) Filed: Nov. 16, 2007

(65) Prior Publication Data

US 2008/0079683 A1 Apr. 3, 2008

Related U.S. Application Data

(63) Continuation of application No. 11/002,390, filed on Dec. 3, 2004, now Pat. No. 7,304,628.

(30) Foreign Application Priority Data

Dec. 4, 2003 (JP) ..... 2003-405804

(51) Int. Cl.
*G09G 3/36* (2006.01)

(52) U.S. Cl. ..... 345/98; 345/89; 345/213

(58) Field of Classification Search ..... 345/87–100, 345/211–213, 204
See application file for complete search history.

(56) References Cited

U.S. PATENT DOCUMENTS 5,936,604 A * 8/1999 Endou ..... 345/101
6,288,697 B1 9/2001 Eto et al.
6,326,943 B1 * 12/2001 Inoue et al. ..... 345/101
6,873,319 B2 * 3/2005 Inoue et al. ..... 345/204
2003/0146896 A1 8/2003 Sekine
2003/0160749 A1 8/2003 Tsuchi
2003/0197672 A1 10/2003 Yun et al.
2003/0201991 A1 10/2003 Goto et al.
2004/0008172 A1 1/2004 Nakamura et al.
2004/0017341 A1 1/2004 Maki
2004/0021627 A1 2/2004 Maki
2004/0027323 A1 2/2004 Tanaka et al.
2006/0164357 A1 7/2006 Isami et al.

FOREIGN PATENT DOCUMENTS

JP 8-129362 5/1996

(Continued)

OTHER PUBLICATIONS

Japanese Patent Office issued a Japanese Office Action dated Apr. 13, 2010, Application No. 2003-405804.

(Continued)

*Primary Examiner* — Kimnhung Nguyen
(74) *Attorney, Agent, or Firm* — Young & Thompson

(57) ABSTRACT

A driver circuit for driving a display device includes N-number of grayscale selecting circuits, which correspond to N-number of data electrodes, each for selecting one grayscale voltage from among a plurality of grayscale voltages in accordance with an image signal; one voltage follower circuit for subjecting the grayscale voltages, which have been selected by the grayscale selecting circuits, to an impedance conversion to thereby drive the data electrodes; and a changeover control circuit for exercising control so as to divide one horizontal interval into at least (N+1)-number of intervals, drive a Kth data electrode by the output of the amplifier circuit by inputting only an output of a Kth grayscale selecting circuit to the amplifier circuit in a Kth (K=1 to N) interval, and drive the Kth data electrode by the output of the Kth grayscale selecting circuit in at least some intervals other than the Kth interval.

5 Claims, 21 Drawing Sheets

FOREIGN PATENT DOCUMENTS

| | | |
|---|---|---|
| JP | 11-327518 | 11/1999 |
| JP | 2000-251176 | 9/2000 |
| JP | 2002-062855 | 2/2002 |
| JP | 2002-108303 | 4/2002 |
| JP | 2002-196726 | 7/2002 |
| JP | 2002-215108 | 7/2002 |
| JP | 2003-302951 | 10/2003 |

OTHER PUBLICATIONS

JP Office Action mailed Apr. 13, 2010 in corresponding Japanese Application No. 2003-405804 with English translation of enclosed wavy line portion.

* cited by examiner

FIG . 10

| R 1 | G 1 | B 1 | R 2 | G 2 | B 2 | ..... |
|---|---|---|---|---|---|---|
| + | − | + | − | + | − | ..... |
| − | + | − | + | − | + | ..... |
| | | | ⋮ | | | |
| + | − | + | − | + | − | ..... |
| − | + | − | + | − | + | ..... |
| − | + | − | + | − | + | ..... |
| + | − | + | − | + | − | ..... |
| | | | ⋮ | | | |
| − | + | − | + | − | + | ..... |
| + | − | + | − | + | − | ..... |

FIG. 17PRIOR ART
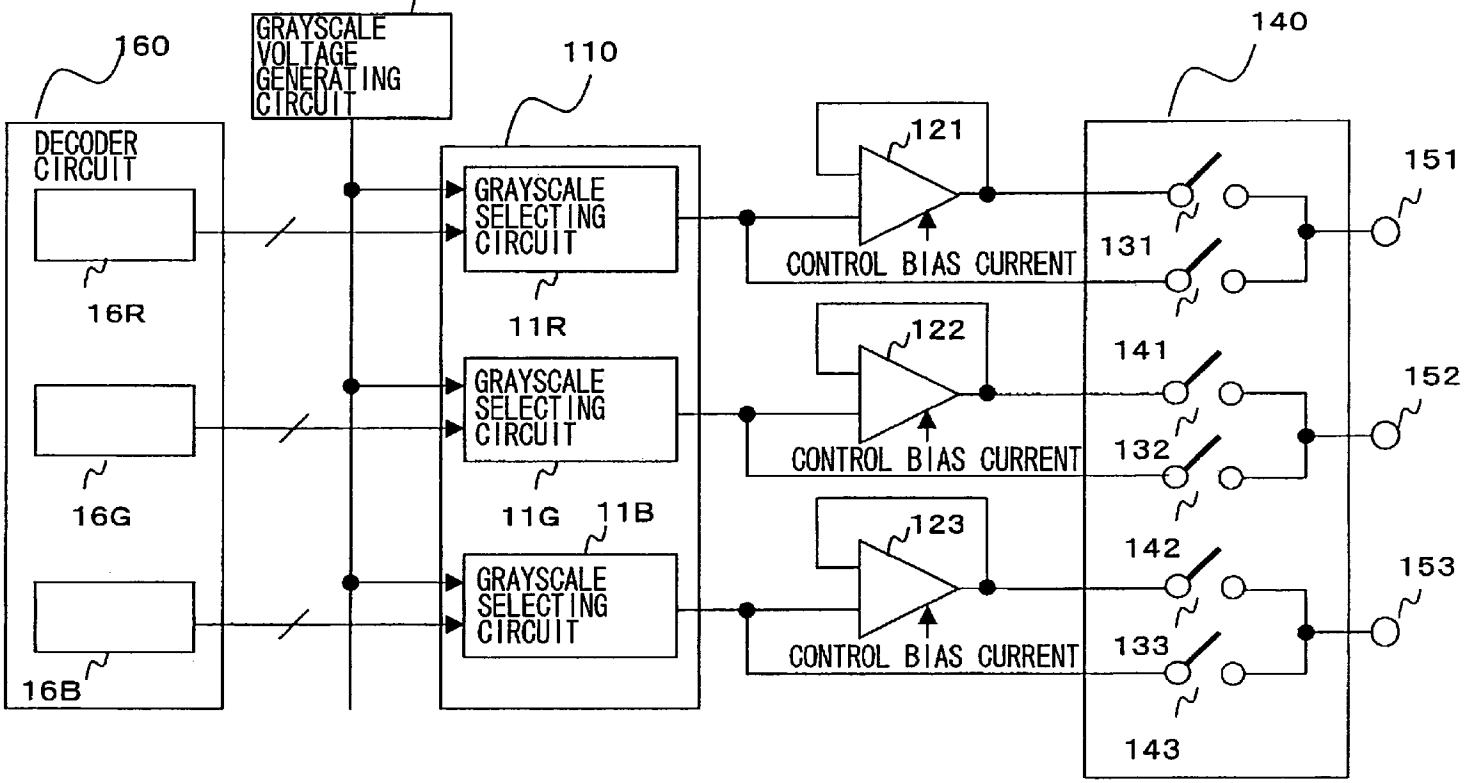

| D2 | D1 | OUT |
|---|---|---|
| L | L | V0 |
| L | H | V1 |
| H | L | V2 |
| H | H | V3 |

DISPLAY DEVICE, DRIVER CIRCUIT THEREFOR, AND METHOD OF DRIVING SAME

FIELD OF THE INVENTION

This invention relates to a display device, a driver circuit for driving the display device, and a method of driving the same. More particularly, the invention relates to a driver circuit for driving data electrodes in a display device having pixel circuits arranged in the form of a matrix, and to the driving method.

BACKGROUND OF THE INVENTION

A display device for a portable electronic device such as a mobile telephone is required to consume little power and to exhibit a high image quality. Accordingly, it is desired that the driver circuit of the display device consume little power and be small in size.

The specification of Japanese Patent Kokai Publication No. JP-P2002-215108A (see FIG. 13 of the specification) discloses a circuit whereby a display device for a portable electronic device such as a mobile telephone is driven with little consumption of power.

FIG. 16 is a block diagram of a 6-bit (64-gray-level) data electrode driving circuit according to the prior art, and FIG. 17 is a detailed circuit diagram of the main components of a driver unit.

As shown in FIG. 16, the driving circuit includes a data buffer circuit 136, which retains, for a prescribed period of time, image signals (D00 to Dxx) input serially in sync with a clock signal CLK, for driving a data bus; a bidirectional shift register circuit 132 to which a horizontal start signal STH is input for generating a sampling signal that has been synchronized to the clock signal; a data register circuit 134 for expanding and holding a digital image signal that enters serially in accordance with the sampling signal that is output from the shift register circuit 132; a data latch circuit 170 for holding all digital image signals in unison in accordance with a latch signal STB; a decoder circuit 160 for decoding the image signals; a grayscale voltage generating circuit 180 for generating grayscale voltages having 64 values set beforehand so as to conform to the gamma characteristic of a liquid crystal; a grayscale selecting circuit 110 for selecting one value from the 64 grayscale voltages in accordance with the image signal; a voltage follower circuit 120 to which the voltage selected by the grayscale selecting circuit 110 is input for driving data electrodes at high speed; a changeover circuit 140 for switching between a connection between the voltage follower circuit 120 and data electrodes 150 and a connection between the grayscale selecting circuit 110 and the data electrodes 150; and a control circuit 138 for controlling the changeover circuit 140, etc.

In FIG. 16, the data register circuit 134, data latch circuit 170, decoder circuit 160, grayscale selecting circuit 110, voltage follower circuit 120 and changeover circuit 140 are individual circuits the number of each of which conforms to the number of data electrodes 150. For example, FIG. 17 represents in detail the main components of a driver unit in regard to a case where there are three data electrodes 150. As shown in FIG. 17, there are decoder circuits 16R, 16G, 16B, grayscale selecting circuits 11R, 11G, 11B and voltage follower circuits 121, 122, 123 provided in correspondence with electrodes 151, 152, 153, respectively. Further, there are switches 141, 142, 143 for connecting the outputs of respective ones of the grayscale selecting circuits 11R, 11G, 11B to electrodes 151, 152, 153, respectively, and switches 131, 132, 133 for connecting the outputs of respective ones of the voltage follower circuits 121, 122, 123, to which the outputs of the grayscale selecting circuits 11R, 11G, 11B, respectively, are input, to the electrodes 151, 152, 153, respectively. The switches 141, 142, 143, 131, 132, 133 correspond to the changeover circuit 140.

Each of the grayscale selecting circuits 11R, 11G, 11B is constituted by 64 analog switches SW0 to SW63 (transfer switches or the like using P-channel transistors and N-channel transistors) of the kind shown in FIG. 19. Grayscale voltages V0 to V63 are applied as inputs to respective ones of the switches, one value is selected from among the 64-value voltages of V0 to V63 and this value is input to the voltage follower circuit 120 and changeover circuit 140.

FIG. 20A illustrates an example of the individual circuits of the decoder circuit 160 and grayscale selecting circuit 110 when an image signal is composed of two bits (D2, D1). The decoder circuit 160 uses NAND gates and inverter circuits. In order to simplify the drawing, the illustrated example is such that the image signal is composed of the two bits and the grayscale selecting circuit 110 is shown as using N-channel transistors, with P-channel transistors being omitted. FIG. 20B illustrates which of the grayscale voltages V0 to V3 is selected and output by the logic of the two bits (D2, D1) in FIG. 20A.

Further, as illustrated in FIG. 21, the grayscale selecting circuit 110 is composed of two transistors, namely an enhancement-type transistor and a depletion-type transistor, and is capable of implementing a decoder function. In such case the decoder circuit 160 is unnecessary. If the arrangement of FIG. 20 is adopted, switch output impedance declines. If the arrangement of FIG. 21 is adopted, a disadvantage is that output impedance rises because a plurality of transistors are connected serially. An advantage, however, is that the area occupied by the device can be reduced because a decoder circuit is not required.

In FIG. 16, the grayscale voltage generating circuit 180 has a plurality of resistors connected in series and generates 64-value grayscale voltages of positive and negative polarities in dependence upon a polarity signal POL.

Further, the power-supply voltage of the drive system of grayscale selecting circuit 110 and voltage follower circuit 120, etc., is higher than that of the circuits (data register circuit 134, etc.) ahead of the data latch circuit 170 and therefore a level shifting circuit (not shown) is inserted on the input side or output side of the data latch circuit 170.

A high driving performance and a broad dynamic range are required as characteristics of the voltage follower circuit 120. There are many cases, therefore, in which a differential input stage is constituted by a rail-to-rail-type amplifier and an output stage as push-pull amplifier.

The operation of the changeover circuit 140 (switches 141, 142, 143, 131, 132, 133) will be described with reference to the timing chart of FIG. 18.

First, if the latch signal STB enters at the "H" level, the image signals held in the data register circuit 134 are transferred to and held in the data latch circuit 170 in unison and one value from among the 64 grayscale-voltages is selected by the grayscale selecting circuit 110 in accordance with the image signals. The changeover circuit 140 at this time is turned off so that no signals are connected to the electrodes 150.

Next, the latch signal STB is sent to the "L" level, the changeover circuit 140 is changed over by the control circuit 138 (the switches 131, 132, 133 are turned on) and the data electrodes 150 (151, 152, 153) are driven at high speed by the voltage follower circuit 120 (121, 122, 123). Next, when the changeover circuit 140 is changed over (switches 131, 132, 133 are turned off and switches 141, 142, 143 are turned on), the data electrodes 150 (151, 152, 153) are driven directly by the voltages selected by the grayscale selecting circuit 110. When driving of the scanned electrodes ends, the changeover circuit 140 is turned off (switches 141, 142, 143 are turned off). Over the interval during which drive is being performed by the grayscale selecting circuit 110, the bias current of the voltage follower circuit 120 (121, 122, 123) is interrupted and the voltage follower circuit 120 (121, 122, 123) is deactivated so that power consumption can be reduced. An AP signal is one that controls a constant-current source of the voltage follower circuit. This signal controls the bias current value in FIG. 17.

The specification of Japanese Patent Kokai Publication No. JP-A-8-129362 (see FIG. 2 of the specification) discloses an example in which a plurality of data electrodes are driven by a single grayscale voltage selecting circuit.

The specification of Japanese Patent Kokai Publication No. JP-A-11-327518 (see FIGS. 1 and 5 of the specification) discloses an apparatus, which is based upon dot-inversion drive, for driving 3'-number of electrodes by a time-division switch and inverting the polarity of an output signal in time-division fashion.

[Patent Document 1]

Japanese Patent Kokai Publication No. JP-P2002-215108A

[Patent Document 2]

Japanese Patent Kokai Publication No. JP-A-8-129362

[Patent Document 3]

Japanese Patent Kokai Publication No. JP-A-11-327518

SUMMARY OF THE DISCLOSURE

A voltage follower circuit generally is used in a circuit that drives data electrodes. A rail-to-rail amplifier employed in a voltage follower circuit has two differential input stages implemented by a P-channel transistor and an N-channel transistor, and the output stage thereof is constituted by a push-pull amplifier. There are many circuit elements because the circuitry is complicated. Further, since oscillation occurs unless a current on the order of 10 μA is passed into an internal constant-current source, it is necessary to take countermeasures such as providing a phase-compensated capacitor. Since the circuit area occupied by the phase-compensated capacitor is large, the voltage follower circuit becomes large in size.

On the other hand, when data electrodes are driven in time-division fashion, a period over which the data electrodes take on a high impedance occurs. If there is a small amount of leakage into a data electrode, therefore, voltage fluctuates and display unevenness occurs.

Accordingly, a technique that employs a voltage follower circuit in time-division fashion to reduce the effective size of the circuitry and that diminishes the occurrence of display unevenness is desired. However, such a technique has not been disclosed heretofore.

Accordingly, an object of the present invention is to reduce the circuit area of an amplifier, which occupies the major part of a data electrode driving circuit, and obtain a display that exhibits a high image quality.

According to a first aspect of the present invention, there is provided a driver circuit for driving a display device, the driver circuit being applicable to a display device having pixel circuits disposed at points of intersection between a plurality of scanning electrodes provided at prescribed intervals and a plurality of data electrodes provided at prescribed intervals. The driver circuit includes N-number (where N is a natural number) of grayscale selecting circuits, which correspond to N-number of the data electrodes, each for selecting one grayscale voltage from among a plurality of grayscale voltages in accordance with an image signal. The driver circuit further includes an amplifier circuit for subjecting the grayscale voltages, which have been selected by the grayscale selecting circuits, to an impedance conversion to thereby drive the data electrodes. The driver circuit further includes a changeover control circuit for exercising control so as to divide one horizontal interval into at least (N+1)-number of intervals, drive a Kth data electrode by the output of the amplifier circuit by inputting only an output of a Kth grayscale selecting circuit to the amplifier circuit in a Kth (K=1 to N) interval, and drive the Kth data electrode by the output of the Kth grayscale selecting circuit in at least some intervals other than the Kth interval.

The changeover control circuit comprises a first switch group that includes N-number of switches, which are associated with K=1 to N, having a first end connected to an output of a Kth (K=1 to N) grayscale selecting circuit and a second end connected to the input of the amplifier circuit; a second switch group that includes N-number of switches, which are associated with K=1 to N, having a first end connected to a Kth (K=1 to N) data electrode and a second end connected to the output of the amplifier circuit; and a third switch group that includes N-number of switches, which are associated with K=1 to N, having a first end connected to the Kth grayscale selecting circuit and a second end connected to the Kth data electrode; the changeover control circuit operating in such a manner that in the Kth interval, the Kth switches in the first and second switch groups are turned on, switches other than the Kth switches in the first and second switch groups are turned off and the Kth switch in the third switch group is turned off, and in at least some intervals other than the Kth interval, the Kth switches of the first and second switch groups are turned off and the Kth switch of the third switch group is turned on.

The driver circuit further comprises a fourth switch group that includes N-number of switches, which are associated with K=1 to N, having a first end connected to a Kth (K=1 to N) data electrode and a second end connected together with the second ends of the other switches of the fourth switch group; all switches included in the fourth switch group being turned on to thereby short all data electrodes only in a prescribed interval of one horizontal interval.

The driver circuit further comprises a short-circuit voltage generating circuit for generating a prescribed voltage; and a fourth switch group that includes N-number of switches, which are associated with K=1 to N, having a first end connected to a Kth (K=1 to N) data electrode and a second end connected to the output of the short-circuit voltage generating circuit together with the second ends of the other switches; all switches included in the fourth switch group being turned on to thereby apply a prescribed voltage to the data electrodes only in a prescribed interval of one horizontal interval.

The driver circuit further comprises a fifth switch group between the grayscale selecting circuits and the first and third switch groups for interchanging the outputs of the grayscale selecting circuits in response to a polarity signal; interchanging means for interchanging image signals, which correspond to the aforesaid interchange, in response to the polarity signal being provided on a supply side of the image signals that is ahead of the grayscale selecting circuits.

The driver circuit further comprises a fifth switch group provided between the data electrodes and the second and third switch groups for interchanging inputs to the data electrodes in accordance with a polarity signal; interchanging means for interchanging image signals, which correspond to the aforesaid interchange, in response to the polarity signal being provided on a supply side of the image signals that is ahead of the grayscale selecting circuits.

Furthermore, the interchange means may be provided on an input or output side of a data latch circuit that holds an image signal for one horizontal interval.

Further, the interchange means may be connected to an output of a shift register to which a start signal of one horizontal interval is input for generating image-signal sampling signals, the interchange means interchanging the image signals by interchanging the sampling signals.

Further, the interchange means may be provided on an output side of a data buffer circuit that holds an image signal only for an interval equivalent to the period of a clock signal and drives a wiring trace to which the image signal is supplied.

The amplifier circuit may be a voltage follower circuit.

Further, the voltage follower circuit may be supplied at least with a bias current over an interval during which data electrodes are driven.

According to a second aspect of the present invention, there is provided a method of driving a display device, the method being applicable to a display device having pixel circuits disposed at points of intersection between a plurality of scanning electrodes provided at prescribed intervals and a plurality of data electrodes provided at prescribed intervals. The method comprises a step of providing N-number (where N is a natural number) of grayscale selecting circuits, which correspond to N-number of data electrodes, each for selecting one grayscale voltage from among a plurality of grayscale voltages in accordance with an image signal. The method further comprises a step of providing an amplifier circuit for subjecting the grayscale voltages, which have been selected by the grayscale selecting circuits, to an impedance conversion to thereby drive the data electrodes. The method further comprises a step of dividing one horizontal interval into at least (N+1)-number of intervals, driving a Kth data electrode by the output of the amplifier circuit by inputting only an output of a Kth grayscale selecting circuit to the amplifier circuit in a Kth (K=1 to N) interval, and driving the Kth data electrode by the output of the Kth grayscale selecting circuit in at least some intervals other than the Kth interval.

The intervals from the first to Nth intervals may be identical.

Further, at least one interval from among the first to Nth intervals may be different from the other intervals.

Furthermore, the (N+1)th interval may be longer than each of the first to Nth intervals.

Further, the order in which data electrodes are driven in a certain frame may be different from the order in which data electrodes are driven in the preceding frame.

The meritorious effects of the present invention are summarized as follows.

According to the present invention, a plurality of data electrodes are driven in time-division fashion by a single voltage follower circuit and the data electrodes are driven by the grayscale selecting circuits even after a prescribed voltage has been attained by the voltage follower circuit. As a result, a deviation in the voltage values of the data electrodes can be kept extremely small. Furthermore, it is possible to correct for any variance ascribable to the offset voltage of the voltage follower circuit. Accordingly, the circuit area of the data electrode driver circuit can be reduced and a high-quality display can be obtained by eliminating display unevenness.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 10 is a diagram useful in describing the principle of dot-inversion drive according to a fourth embodiment of the present invention;

FIG. 17 is a detailed circuit diagram of the main components of a driver unit according to the prior art;

PREFERRED EMBODIMENTS OF THE INVENTION

Figure 1:
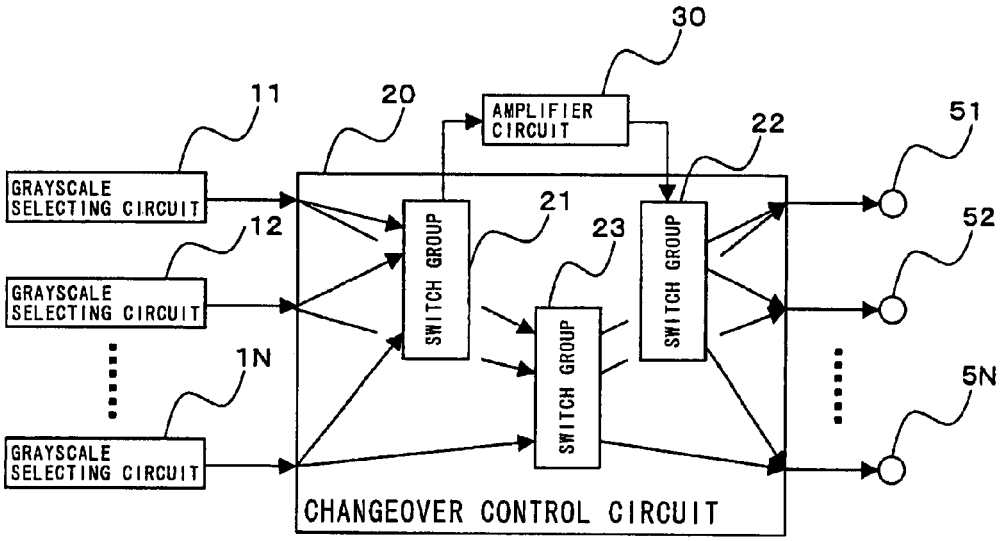
FIG. 1 is a block diagram illustrating a driver circuit for driving a display device according to a mode of carrying out the present invention.

A preferred mode of carrying out the present invention will now be described with reference to the drawings, in which FIG. 1 is a block diagram illustrating a driver circuit for driving a display device according to a mode of carrying out the present invention. As shown in FIG. 1, the driver circuit drives a display device having pixel circuits disposed at points of intersection between a plurality of scanning electrodes provided at prescribed intervals and a plurality of data electrodes 51, 52, . . . , 5N provided at prescribed intervals. The driver circuit includes grayscale selecting circuits 11, 12, . . . , 1N, which correspond to N-number (where N represents a natural number) of data electrodes 51, 52, . . . , 5N, each for selecting one grayscale voltage from among a plurality of grayscale voltages in accordance with an image signal. The driver circuit further includes an amplifier circuit 30 for subjecting the grayscale voltages, which have been selected by the grayscale selecting circuits 11, 12, . . . , 1N, to an impedance conversion to thereby drive the data electrodes 51, 52, . . . , 5N.

The driver circuit further includes a changeover control circuit 20 for exercising control so as to divide one horizontal interval into at least (N+1)-number of intervals, drive a Kth data electrode 5K by the output of the amplifier circuit 30 by inputting only an output of a Kth grayscale selecting circuit 1K to the amplifier circuit 30 in a Kth (K=1 to N) interval, and drive the Kth data electrode 5K by the Kth grayscale selecting circuit 1K in at least some intervals other than the Kth interval.

The changeover control circuit 20 comprises a first switch group 21 that includes N-number of switches, which are associated with K=1 to N, having a first end connected to an output of the Kth (K=1 to N) grayscale selecting circuit 1K and a second end connected to the input of the amplifier circuit 30; a second switch group 22 that includes N-number of switches, which are associated with K=1 to N, having a first end connected to the Kth (K=1 to N) data electrode 5K and a second end connected to the output of the amplifier circuit 30; and a third switch group 23 that includes N-number of switches, which are associated with K=1 to N, having a first end connected to the Kth grayscale selecting circuit 1K and a second end connected to the Kth data electrode 5K.

Figure 2:
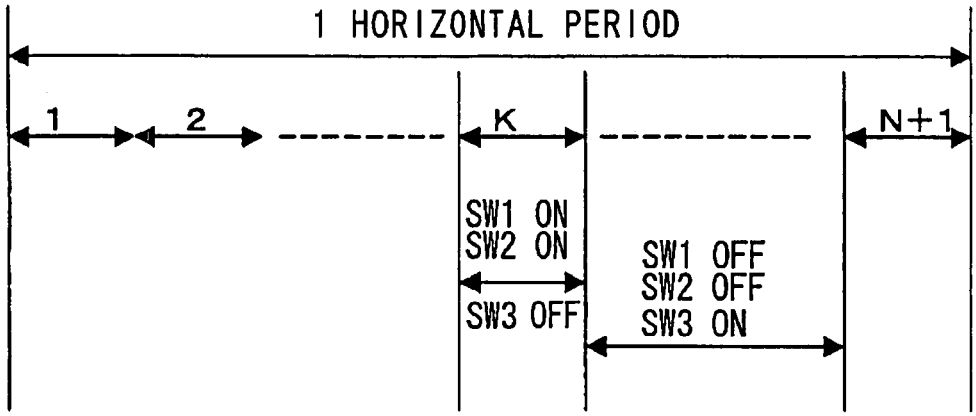
FIG. 2 is an operation timing chart illustrating the operation of a driver circuit for driving a display device according to a mode of carrying out the present invention.

Operation will now be described with regard to an operation timing chart of the driver circuit constructed as shown in FIG. 1. FIG. 2 is an operation timing chart illustrating the operation of the driver circuit for driving the display device according to this mode of carrying out the present invention. As shown in FIG. 2, one horizontal interval is divided into at least (N+1)-number of intervals. In a Kth interval, the Kth switches (SW1 and SW2) in the first and second switch groups 21 and 22, respectively, are turned on, switches other than the Kth switches in the first and second switch groups are turned off and the Kth switch (SW3) in the third switch group 23 is turned off. In at least some intervals other than the Kth interval, the Kth switches (SW1 and SW2) of the first and second switch groups 21 and 22, respectively, are turned off and the Kth switch (SW3) of the third switch group 23 is turned on.

As described above, the driver circuit for the display device according to this mode of carrying out the present invention is such that the Kth data electrode 5K is driven by the amplifier circuit 30 in the Kth interval and is driven directly by the grayscale selecting circuit 1K in at least some intervals other than the Kth interval. Accordingly, in the first to Nth intervals, the amplifier circuit 30 is connected in time-division fashion to N-number of grayscale selecting circuits and N-number of data electrodes. The number of amplifier circuits 30, therefore, is 1/N of the number of data electrodes and the circuit area of the driver circuit can be reduced. Further, in some of the intervals where the data electrodes are not driven by the amplifier circuit 30, the Kth data electrode 5K is driven directly by the grayscale selecting circuit 1K. Accordingly, it is possible to shorten greatly the interval in which the data electrode 5K takes on a high impedance following drive by the amplifier circuit 30, and a deviation in the voltage value of the data electrode 5K can be made very small. Further, it is possible to correct for generation of an offset voltage by the amplifier circuit 30. As a result, display unevenness can also be reduced and a display with a high image quality can be obtained.

Figure 3:
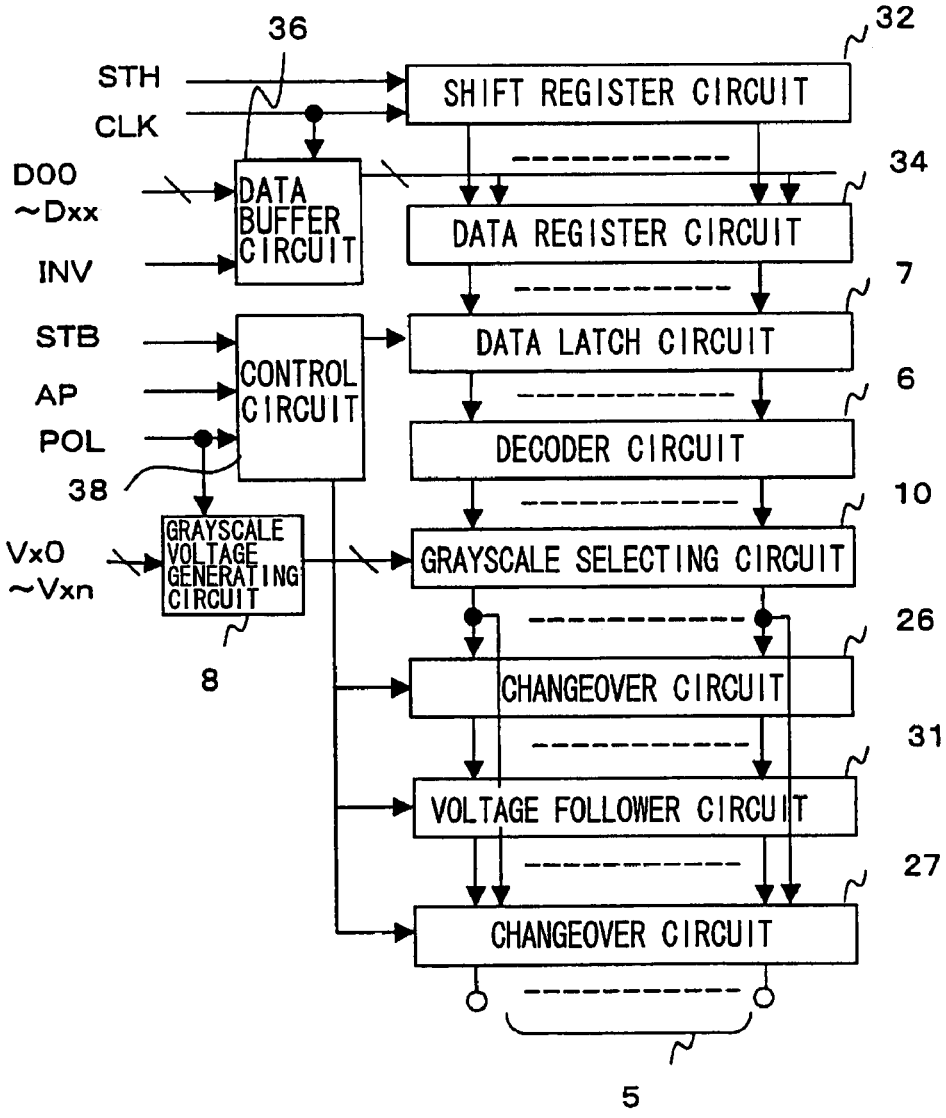
FIG. 3 is a block diagram illustrating a data electrode driving circuit according to a first embodiment of the present invention.

A first embodiment of the present invention will now be described in detail with reference to the drawings. FIG. 3 is a block diagram illustrating a data electrode driving circuit according to a first embodiment of the present invention. The driving circuit includes a data buffer circuit 36, which retains, for a prescribed period of time, image signals (D00 to Dxx) input serially in sync with a clock signal CLK, for driving a data bus; a bidirectional shift register circuit 32 to which a horizontal start signal STH is input for generating a sampling signal; a data register circuit 34 for expanding and holding a digital image signal that enters serially in accordance with the sampling signal; a data latch circuit 7 for holding all digital image signals in unison in accordance with a latch signal STB; a decoder circuit 6 for decoding the image signals; a grayscale voltage generating circuit 8 for generating positive and negative grayscale voltages having, e.g., 64 values set beforehand so as to conform to the gamma characteristic of a liquid crystal; a grayscale selecting circuit 10 for selecting one value from the positive and negative 64 grayscale-voltage values in accordance with the image signal; a voltage follower circuit 31 to which the voltage selected by the grayscale selecting circuit 10 is input for driving data electrodes at high speed; a changeover circuit 26 between the grayscale selecting circuit 10 and the voltage follower circuit 31; a changeover circuit 27 for switching between the output of the voltage follower circuit 31 and the output of the grayscale selecting circuit 10 and connecting the selected output to data electrodes 5; and a control circuit 38 for controlling the changeover circuit 26, changeover circuit 27 and data latch circuit 7.

Figure 19:
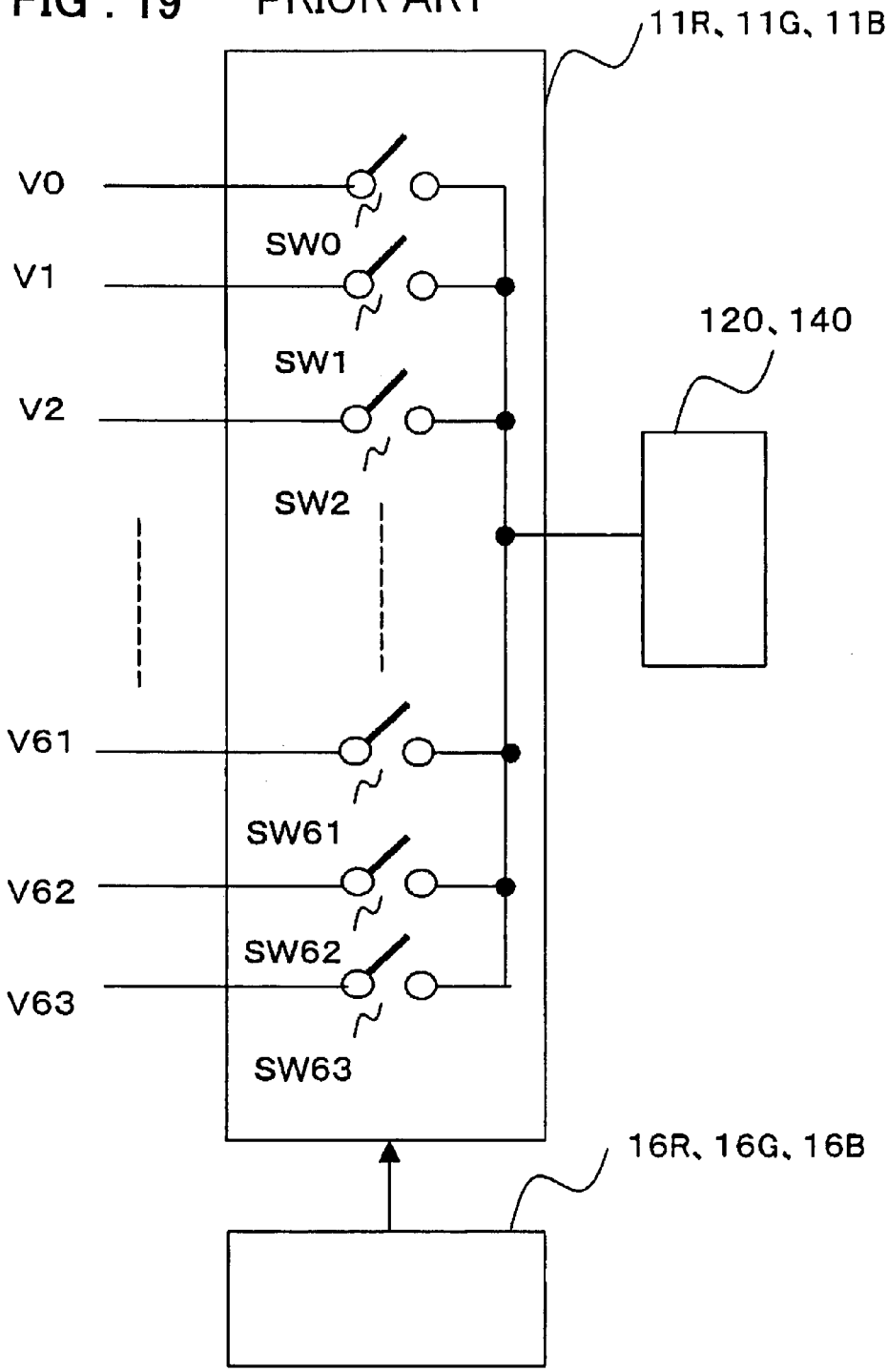
FIG . 19 PRIOR ART
FIG. 19 illustrates an example of the structure of a grayscale selecting circuit according to the prior art.
Figures 20A, 20B:
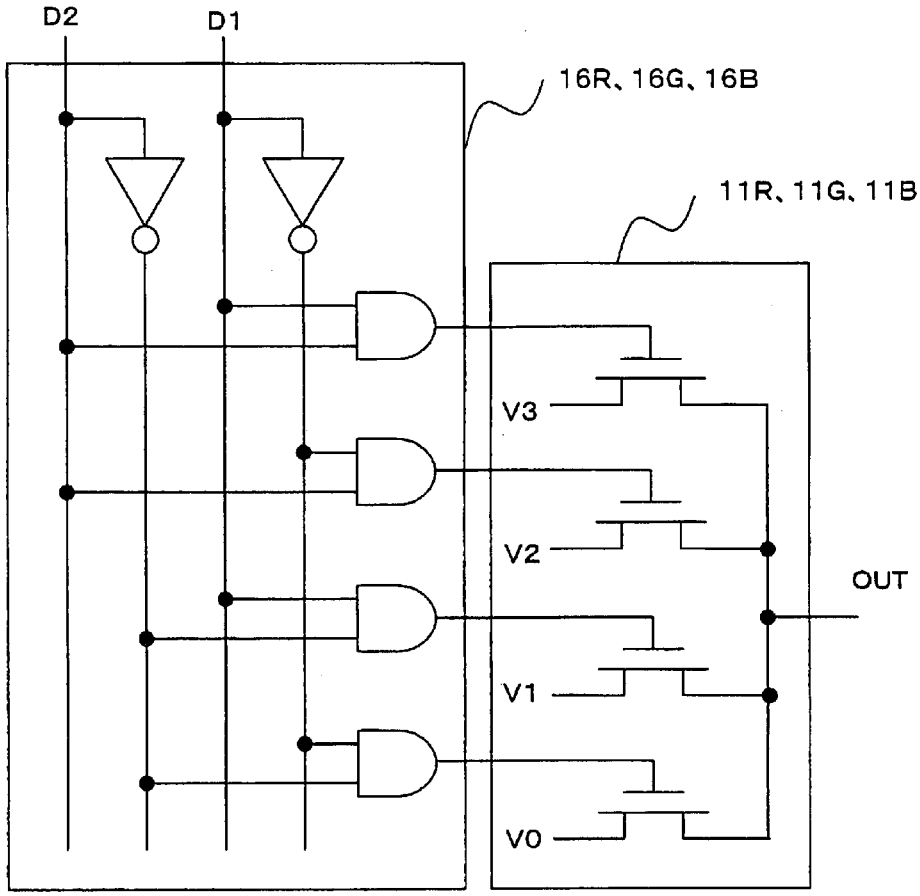
FIG . 20A PRIOR ART
FIG . 20B PRIOR ART
FIGS. 20A and 20B illustrate an example of the structure of a decoder circuit and grayscale selecting circuit according to the prior art.
Figure 21:
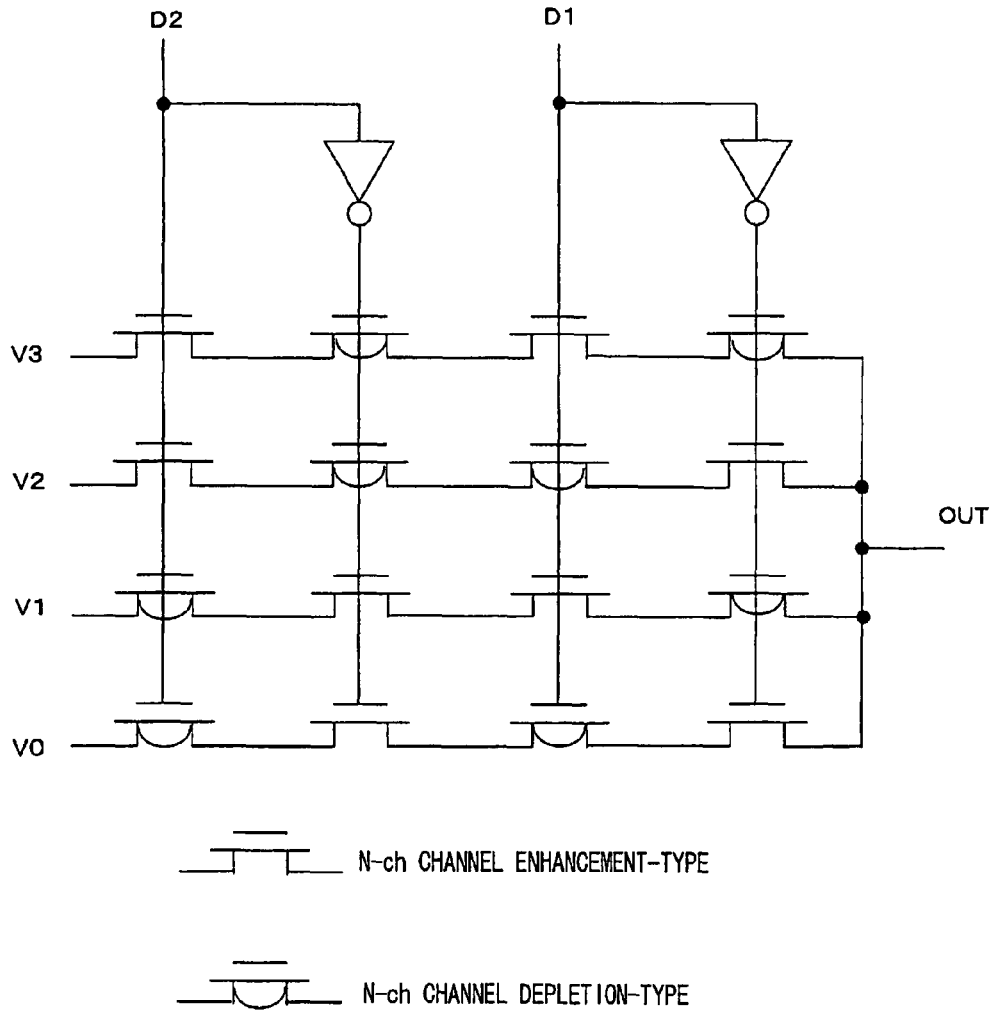
FIG . 21 PRIOR ART
FIG. 21 illustrates an example of the structure of another decoder circuit and grayscale selecting circuit according to the prior art.

As described above with reference to FIG. 19, the grayscale selecting circuit 10 is constituted by, e.g., 64 switches (transfer switches or the like using P-channel transistors and N-channel transistors). Grayscale voltages V0 to V63 are applied to the inputs of respective ones of the switches and one value is selected from among the 64-value voltages of V0 to V63 in accordance with the image signal. Further, a grayscale selecting circuit of the kind described in FIG. 20 or 21 may be used. In a case where driving is performed on a time-division basis, it is better if the output impedance of the grayscale selecting circuit is low and therefore it is desired that a grayscale selecting circuit of the kind described in FIG. 20 be used.

The grayscale voltage generating circuit 8 has a plurality of resistors connected in series and generates 64-value grayscale voltages of positive and negative polarities, which have been set beforehand so as to conform to the gamma characteristic, from connection electrodes. The grayscale voltages are supplied to the grayscale selecting circuit 10.

The control circuit 38 controls the timing of various circuits such as the changeover circuits 26, 27 based upon the frequency-divided clock CLK, etc.

Further, the power-supply voltage of the drive system of grayscale selecting circuit 10 and voltage follower circuit 31, etc., is higher than that of the circuits (data register circuit 34, shift register circuit 32, etc.) ahead of the data latch circuit 7 and therefore a level shifting circuit (not shown) is inserted on the input side or output side of the data latch circuit 7.

Figure 4:
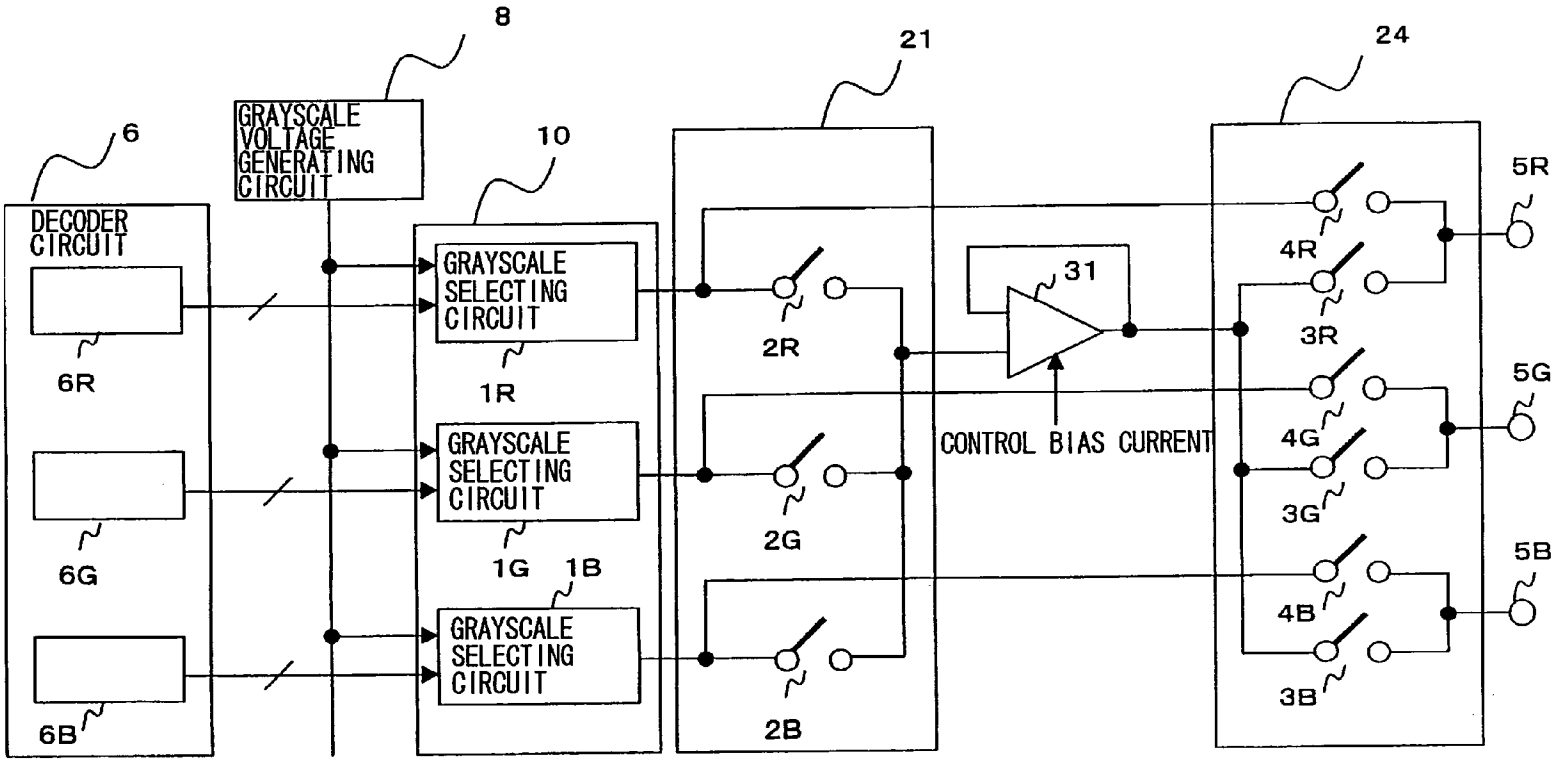
FIG. 4 is a circuit diagram of the main components of the data electrode driving circuit according to the first embodiment.

The circuitry of the main components of the data electrode driving circuit will be described next. FIG. 4 is a circuit diagram of the main components of the data electrode driving circuit according to the first embodiment. FIG. 4 illustrates a case where the data electrodes are three in number (5R, 5G, 5B). Decoder circuits 6R, 6G, 6B, grayscale selecting circuits 1R, 1G, 1B, switches 2R, 2G, 2G, switches 3R, 3G, 3B and switches 4R, 4G, 4B are provided in correspondence with electrodes 5R, 5G, 5B, respectively. Accordingly, the description will be rendered only with regard to data electrode 5R. It should be noted that the circuitry of the main components also includes the grayscale voltage generating circuit 8 and the voltage follower circuit 31 that can be deactivated by cutting off the bias current.

The output of the decoder circuit 6R is input to the grayscale selecting circuit 1R. In accordance with the output of the decoder circuit 6R, the grayscale selecting circuit 1R selects a prescribed value from among the grayscale voltages that are output by the grayscale voltage generating circuit 8 and outputs this value to one end of switch 2R and one end of switch 4R. The other end of switch 2R is connected to the other end of switch 2G, the other end of switch 2B and is input to the voltage follower circuit 31. The output of the voltage follower circuit 31 is connected to one end of switch 3R, one end of switch 3G and one end of switch 3B. The other end of switch 4R and the other end of switch 3R are connected to the data electrode 5R.

Figure 5:
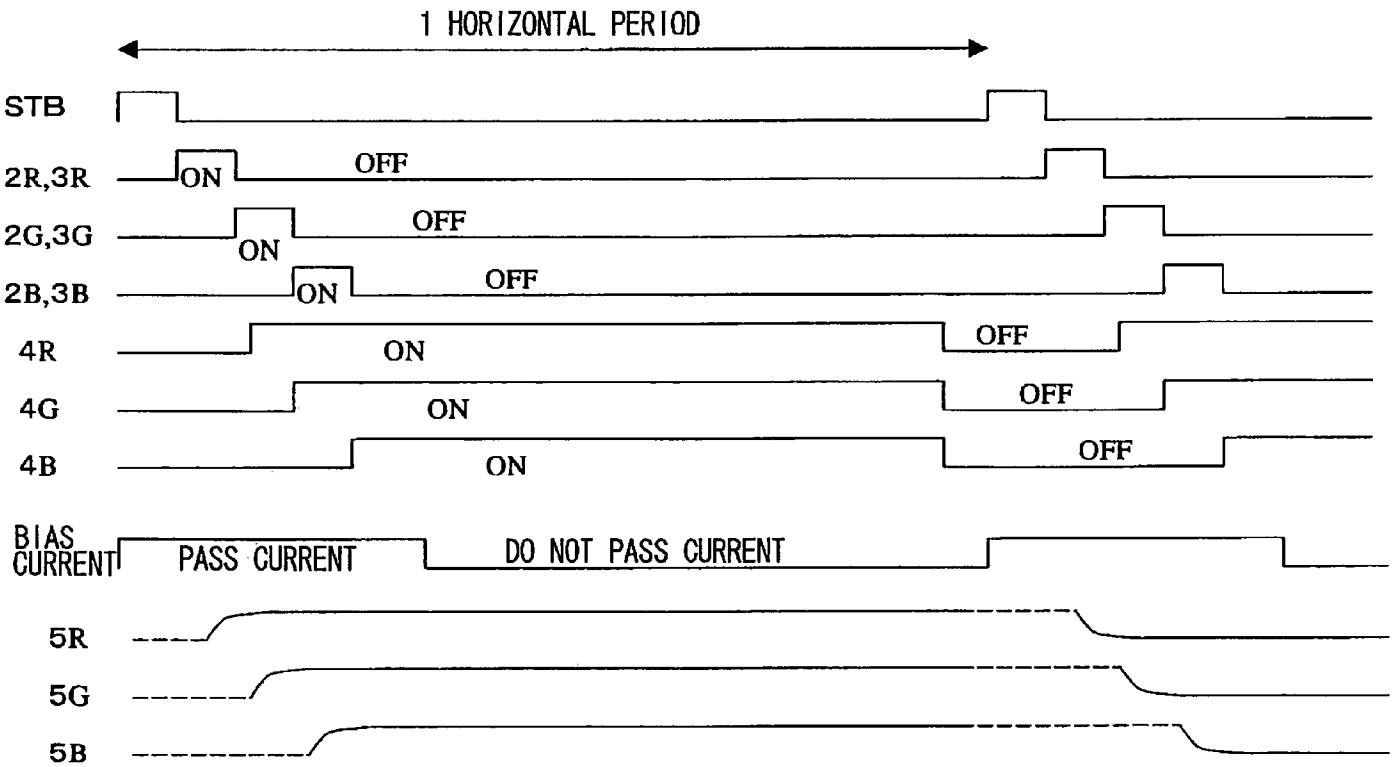
FIG. 5 is an operation timing chart illustrating the operation of the main components of a driver circuit according the first embodiment of the present invention.

The operation timing chart of the circuitry shown in FIG. 4 will now be described with reference to FIG. 5, which is an operation timing chart illustrating the operation of the main components of a driver circuit according the first embodiment of the present invention. In FIG. 5, one horizontal interval is divided into at least four driving intervals.

First, if the latch signal STB enters at the "H" level, the image signals held in the data register circuit 34 are transferred to and held in the data latch circuit 7 in unison and one value from among the prescribed number of grayscale values is selected by the grayscale selecting circuit 10 (1R, 1G, 1B) in accordance with the image signals. The switches 2R, 2G, 2B, 3R, 3G, 3B, 4R, 4B, 4G are off at this time.

In the first driving interval, the data electrode 5R is driven by the voltage follower circuit 31. The control circuit 38 turns on the switches 2R and 3R in the order mentioned and the voltage follower circuit 31 drives the data electrode 5R at high speed. Next, when the switches 3R and 2R are turned off in order and the switch 4R is turned on, the voltage that has been selected by the grayscale selecting circuit 1R is applied directly to the data electrode 5R. Since the voltage difference between the output of the voltage follower circuit 31 and the output of the grayscale selecting circuit 1R is a value that is substantially the same within about ±10 mV, this is an operation closer to the holding of voltage than to a driving operation.

In the second driving interval, the data electrode 5G is driven by the voltage follower circuit 31. The switches 2G and 3G are turned on in the order mentioned, and the data electrode 5G is driven at high speed by the voltage follower circuit 31. Next, when the switches 3G and 2G are turned off in order and the switch 4G is turned on, the voltage that has been selected by the grayscale selecting circuit 1G is applied directly to the data electrode 5R.

In the third driving interval, the data electrode 5B is driven by the voltage follower circuit 31. The switches 2B and 3B are turned on in the order mentioned, and the data electrode 5B is driven at high speed by the voltage follower circuit 31. Next, when the switches 3B and 2B are turned off in order and the switch 4B is turned on, the voltage that has been selected by the grayscale selecting circuit 1B is applied directly to the data electrode 5B.

Figure 6:
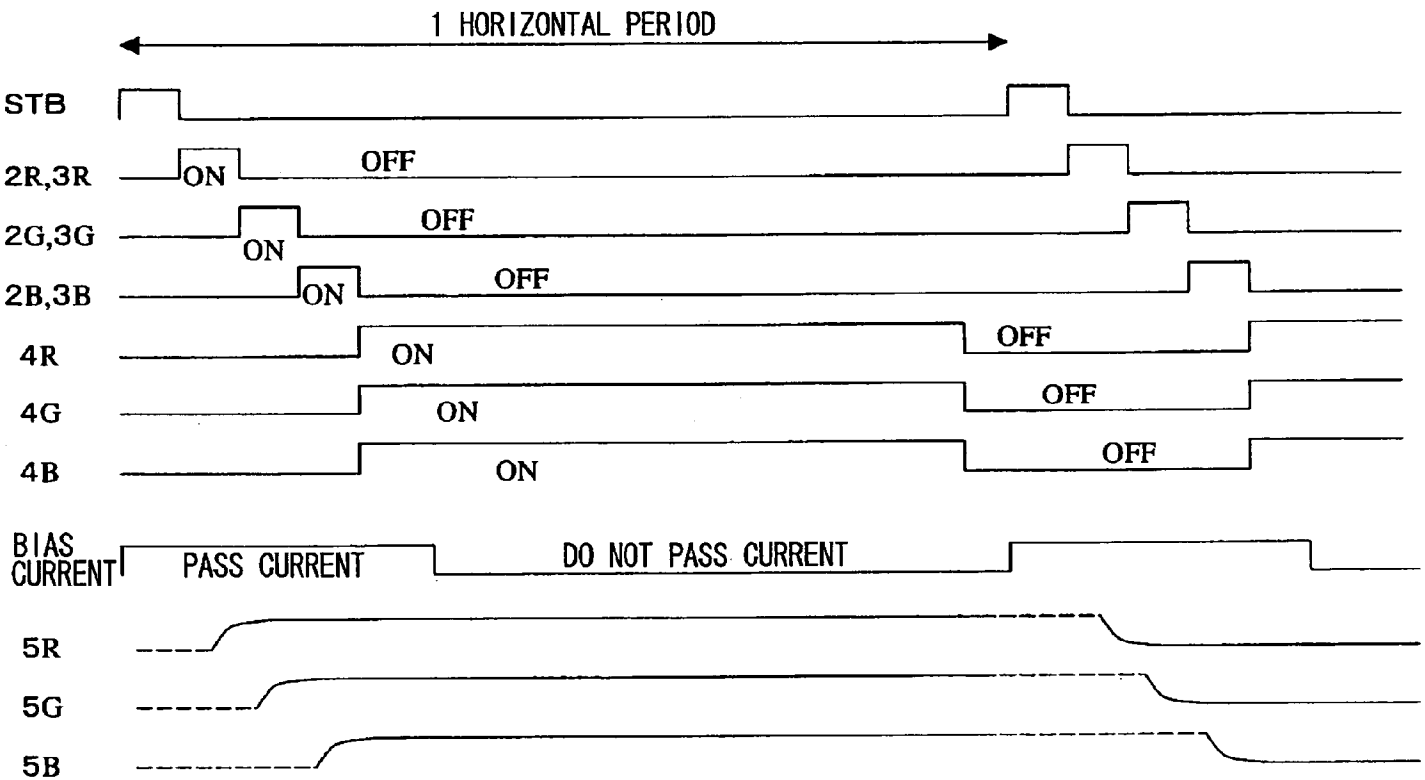
FIG. 6 is another operation timing chart illustrating the operation of the main components of a driver circuit according the first embodiment of the present invention.

The timing at which the switches 4R, 4G, 4B are turned on is not limited to the timing shown in FIG. 5. It may be so arranged that the switches 4R, 4G, 4B are turned on in unison after the driving of the voltage follower circuit 31 ends, as shown in FIG. 6.

When driving of each data electrode is ended by the voltage follower circuit 31, the voltage follower circuit 31 remains in the active state. However, it is preferred that the bias current to the voltage follower circuit 31 be cut off to place the voltage follower circuit 31 is the deactivated state, thereby reducing consumption of power. It should be noted that the AP signal is one that controls the bias current value of the voltage follower circuit 31.

Further, the voltage follower circuit 31 is an amplifier whose gain is one. In general, however, an amplifier has an offset value (the difference between the input and output voltages) owing to a variance ascribable to manufacture or the like, and the value of the offset voltage is about ±10 mV. The offset voltage of the voltage follower circuit 31 can be corrected for by performing drive directly by the grayscale selecting circuits 1R, 1G, 1B.

In FIG. 4, three data electrodes are driven by the single voltage follower circuit 31. However, four or more data electrodes may be driven. The number of times a write operation is performed by the voltage follower circuit 31 will be calculated by way of example.

In terms of parameters, let 5 μs be the time required to drive one data electrode by the voltage follower circuit 31, let ±10 mV represent the offset voltage of the voltage follower circuit 31, let 30 pF be the parasitic capacitance of the data electrodes, and let 500 KΩ be the output impedance of the grayscale selecting circuit 1R (1G, 1B) switch 4R (4G, 4B). Further, let ±5 mV be a voltage difference that is recognizable by the human eye when a liquid crystal display is observed.

A time constant $\tau$ that prevails when drive is performed by the grayscale selecting circuit 1R is $\tau$=RC=50 KΩ×30 pF=15 μs. In order to apply a correction up to a voltage difference of ±5 mV, which cannot be recognized by the human eye, at a voltage error in the voltage follower circuit 31 of ±10 mV, it will suffice to apply a voltage correction of about 50%. Since 50% corresponds to about 0.69$\tau$, the driving time should be 15 μs×0.69=about 10.4 μs.

In a case where the display screen is of the QVGA (240 pixels×RGB×320 pixels) type, one horizontal interval is about 50 μs at a frame frequency of 60 Hz and therefore drive is capable of being performed up to (50-10.4) μs 15 μs=7.92 times.

In actuality, it is preferred that the data electrodes be driven in units of the three colors R, G, B. It is desirable, therefore, that drive be performed twice for each of R, G, B, for a total of six times.

If we assume that the data electrodes are R1, G1, B1, R2, G2, B2 in a case where drive is applied six times, then, by changing the order in which the electrodes are driven, as by driving the electrodes in the order R1-G1-B1-R2-G2-B2 in a Jth frame and in the order B2-G2-R2-B1-G1-R1 in a (J+1)th frame, and averaging the driving times, color unevenness can be reduced further and excellent image quality can be obtained. It should be noted that the order may be a random one, by way of example.

In general, each of the driving intervals from the first to the sixth driving intervals are the same. However, it is not necessarily required to adhere to such an arrangement. For example, each of the driving intervals from the first to the fifth driving intervals may be set to 3 μs and the sixth driving interval may be set to 5 μs. Further, all of the first to the sixth driving intervals may be made to differ from one another, as in the following manner: first driving interval=2.5 μs; second driving interval=3 μs; third driving interval=3.5 μs; fourth driving interval=4 μs; fifth driving interval=4.5 μs; sixth driving interval=5 μs. If enough time to make the correction can be acquired in the grayscale selecting circuits, then no problems will arise even if the initial driving interval is made short.

Figure 7:
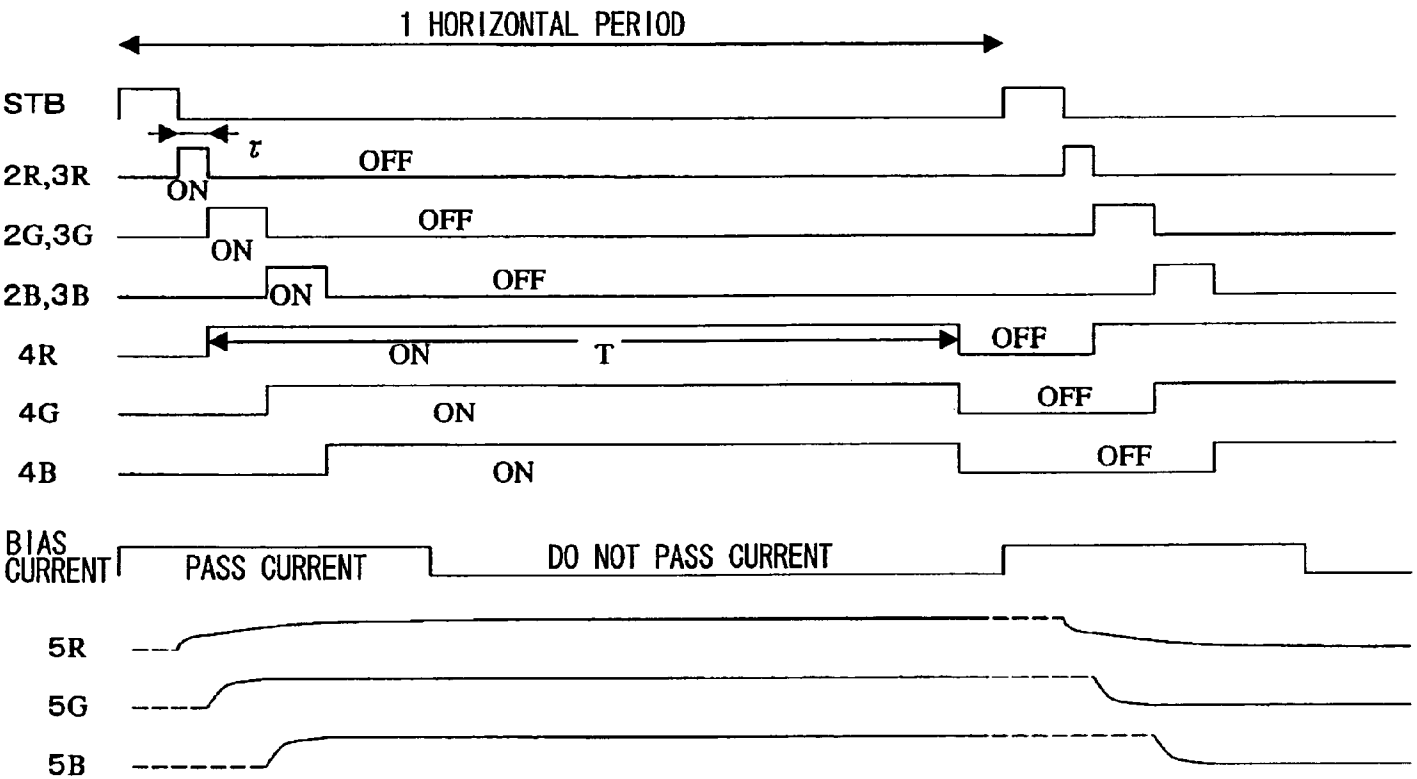
FIG. 7 is yet another operation timing chart illustrating the operation of the main components of a driver circuit according the first embodiment of the present invention.

This situation is illustrated in FIG. 7. Here the ON time τ of the switches 2R, 3R is made shorter in comparison with FIG. 5. When this is done, an unsatisfactory waveform for the rise time indicated at electrode 5R is produced. However, if the ON time T of switch 4R is long enough, the target voltage will be attained. For example, assume that one horizontal interval is 50 μs. Even in the event that drive is performed six times, the driving time of the first driving interval is 2.5 μs and several tens of millivolts cannot be written with respect to the target voltage, if 47.5 μs of time remains, then it will be possible to correct the remaining several tens of millivolts by drive performed by the grayscale selecting circuit.

Described next will be a method of increasing the number of driving operations in one horizontal interval by shortening electrode driving time in an interval that is near the interval in which the latch signal STB is at the "H" level. Assume that one horizontal interval is 50 μs as in the description rendered above. In the previous example (where the first to fifth driving intervals are 2.5, 3, 3.5, 4, 4.5 and 5 μs, respectively), a period of 17.5 μs elapses by the time drive starts in the sixth driving interval (5 μs), and therefore the remaining time in the sixth driving interval is 32.5 μs. Accordingly, even if the remaining time is short in comparison with the initial driving interval, the driving time of the voltage follower is lengthened in such a manner that writing in the final driving interval will be achieved by the voltage follower circuit up to a value close to the target voltage in order that a correction of several tens of millivolts can be performed sufficiently by the grayscale selecting circuit.

Furthermore, assume that the driving time of the voltage follower circuit is made 5 μs across the board. With driving applied six times, a total time of 30 μs will be required. If time is allocated as described in the previous example, drive applied six times will require 22.5 μs. If 7.5 μs is available, therefore, a driving period for drive three times (2.5×3 μs) can be added to the initial time and writing can be performed nine times (where the driving intervals are 2.5, 2.5, 2.5, 2.5, 3, 3.5, 4, 4.5 and 5 μs, for a total of 30 μs). Since circuitry that shares one voltage follower circuit can be increased further by adopting this expedient, the size of the circuitry can be reduced further.

Thus, as described above, a plurality of data electrodes are driven in time-division fashion by a single voltage follower circuit, after which a voltage conforming to the image signal is applied directly to the data electrodes by the grayscale selecting circuit 10 through the switching action of the changeover circuits 26, 27. The number of voltage follower circuits provided for every data electrode in the prior art can be reduced to 1/N (where N is a natural number and $n \geqq 2$ holds). This makes it possible to reduce the scale of the circuitry.

Further, if there is a slight amount of leakage into a data electrode at the time of time-division drive of the data electrodes, electric charge escapes owing to the high impedance (high Z) of the data electrode and the voltage will deviate from the desired voltage, resulting in display unevenness. According to the present invention, however, the data electrode is driven directly by the grayscale selecting circuit 10 also following drive by the voltage follower circuit and therefore the occurrence of display unevenness can be made very small. Furthermore, since a variance in the offset voltage of the voltage follower circuit is corrected for, an even better display can be obtained.

A second embodiment of the invention will be described with reference to FIG. 8, which is a circuit diagram of the main components of a data electrode driving circuit according to a second embodiment of the present invention. Components identical with or corresponding to those of FIG. 4 are designated by like reference characters and need not be described again.

Figure 8:
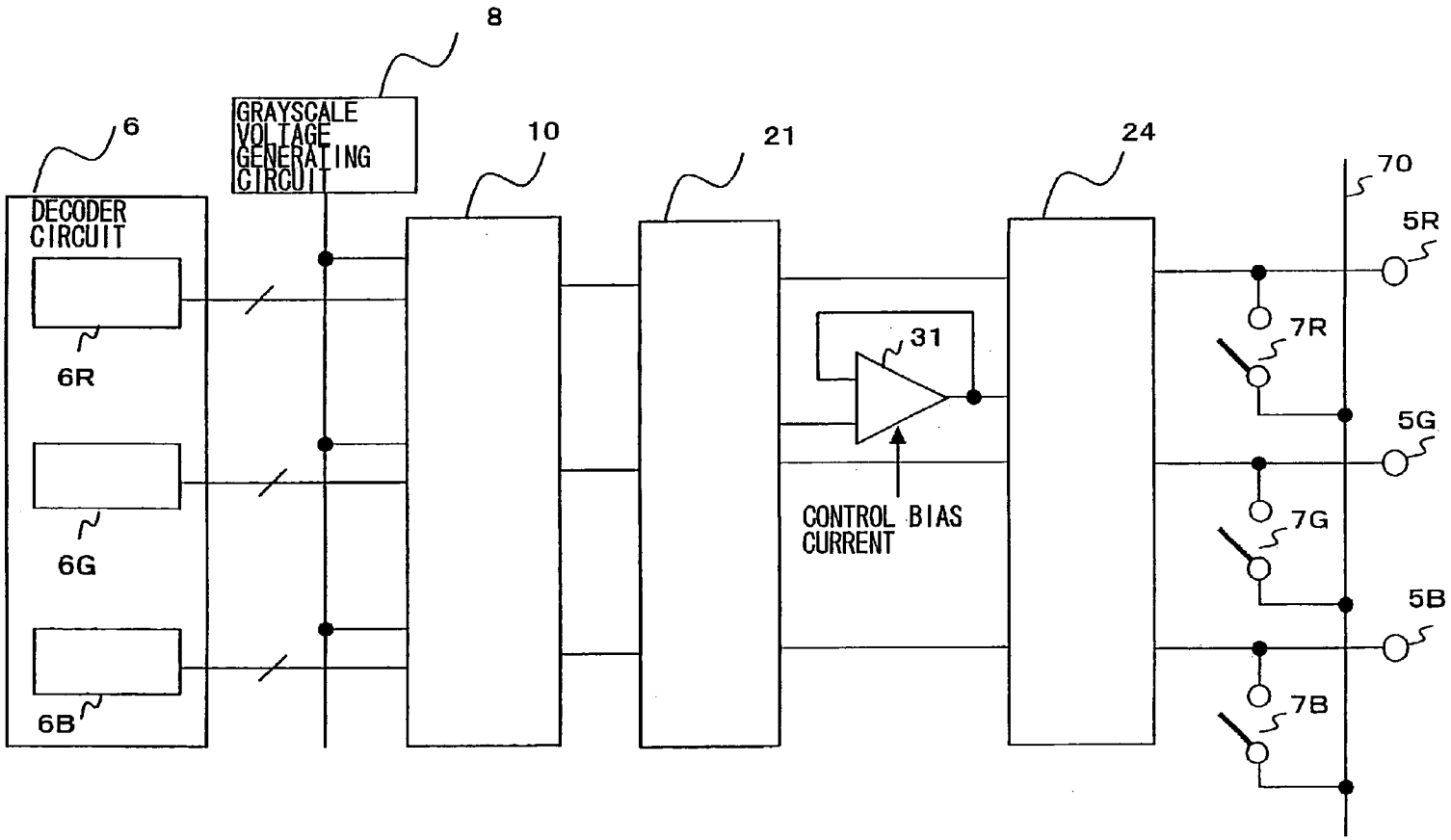
FIG. 8 is a circuit diagram of the main components of a data electrode driving circuit according to a second embodiment of the present invention.

FIG. 8 differs from FIG. 4 in that switches 7R, 7G, 7B and wiring 70 are additionally provided, the switches 7R, 7G, 7B are connected at one end to the data electrodes 5R, 5G, 5B, respectively, and at the other end to the wiring 70. The data electrodes 5R, 5G, 5B can be initialized by being shorted.

Operation will be described next. The changeover circuits 21 and 24 are in the OFF state while the latch signal STB is at the "H" level in the timing chart of FIG. 5. If the switches 7R, 7G, 7B are turned on in unison in this interval, the voltages at the data electrodes 5R, 5G, 5B are averaged.

If the averaged voltage is, e.g., 2 V in an operating voltage range of 0 to 5V, then, by virtue of the initialization operation, the voltage difference the next time driving is performed will be less than 2 to 3 V, the driving current declines and power consumption can be reduced.

Figure 9:
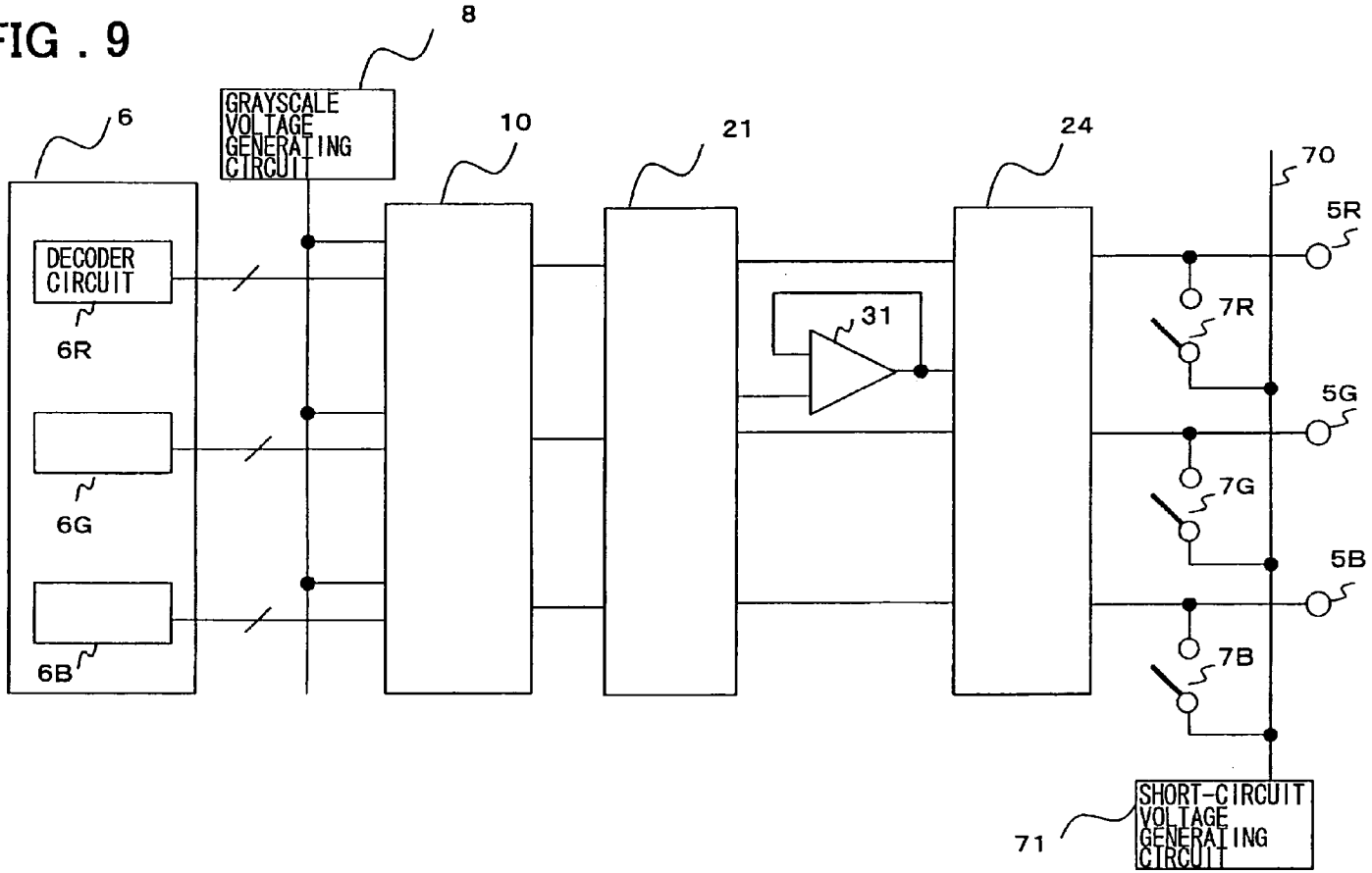
FIG. 9 is a circuit diagram of the main components of a data electrode driving circuit according to a third embodiment of the present invention.

In the second embodiment, the data electrodes 5R, 5G, 5B are initialized simply by being shorted in the interval during which the latch signal STB is at the "H" level. However, any voltage between the high- and low-order voltage of the driving voltage may be applied to each of the data electrodes 5R, 5G, 5B. FIG. 9 is a circuit diagram of the main components of a data electrode driving circuit according to a third embodiment of the present invention. Components identical with or corresponding to those of FIG. 8 are designated by like reference characters and need not be described again.

FIG. 9 differs from FIG. 8 in that the wiring 70 is connected to the output of a short-circuit voltage generating circuit 71. In the interval during which the latch signal STB is at the "H" level, the data electrodes 5R, 5G, 5B are shorted and an output voltage from the short-circuit voltage generating circuit 71 is applied to effect initialization. This output voltage is made a voltage that is one-half the high- and low-order voltages, thereby making it possible to maximize the power-consumption reducing effect.

A fourth embodiment of the invention will be described with reference to FIGS. 10 to 15. FIG. 10 is a diagram useful in describing the principle of dot-inversion drive according to a fourth embodiment of the present invention. In order to drive liquid crystal, it is preferred that AC drive be performed so as not to cause deterioration of the liquid crystal. In general, line inversion drive, in which polarity is inverted for every pixel on a horizontal line, and dot-inversion drive, in which polarity is inverted between mutually adjacent pixels, are known in the art. The fourth embodiment will be described with regard to a driver circuit and driving method when dot-inversion drive is carried out.

With voltage at the common electrode of a liquid crystal serving as the reference, voltage on the positive side shall be referred to as "voltage on the positive-electrode side" and voltage on the negative side shall be referred to as "voltage on the negative-electrode side".

In the fourth embodiment, it is assumed that mutually adjacent data electrodes are driven alternatingly by a voltage "+" on the positive-electrode side and a voltage "−" on the negative-electrode side, as illustrated in FIG. 10. Accordingly, with dot inversion, the polarities of mutually adjacent data electrodes differ (e.g., see R1 and G1, G1 and B1). Consequently, 64 levels of the grayscale are output simultaneously for each of the positive and negative electrodes. This means that grayscale voltages of 128 levels are required.

Figure 11:
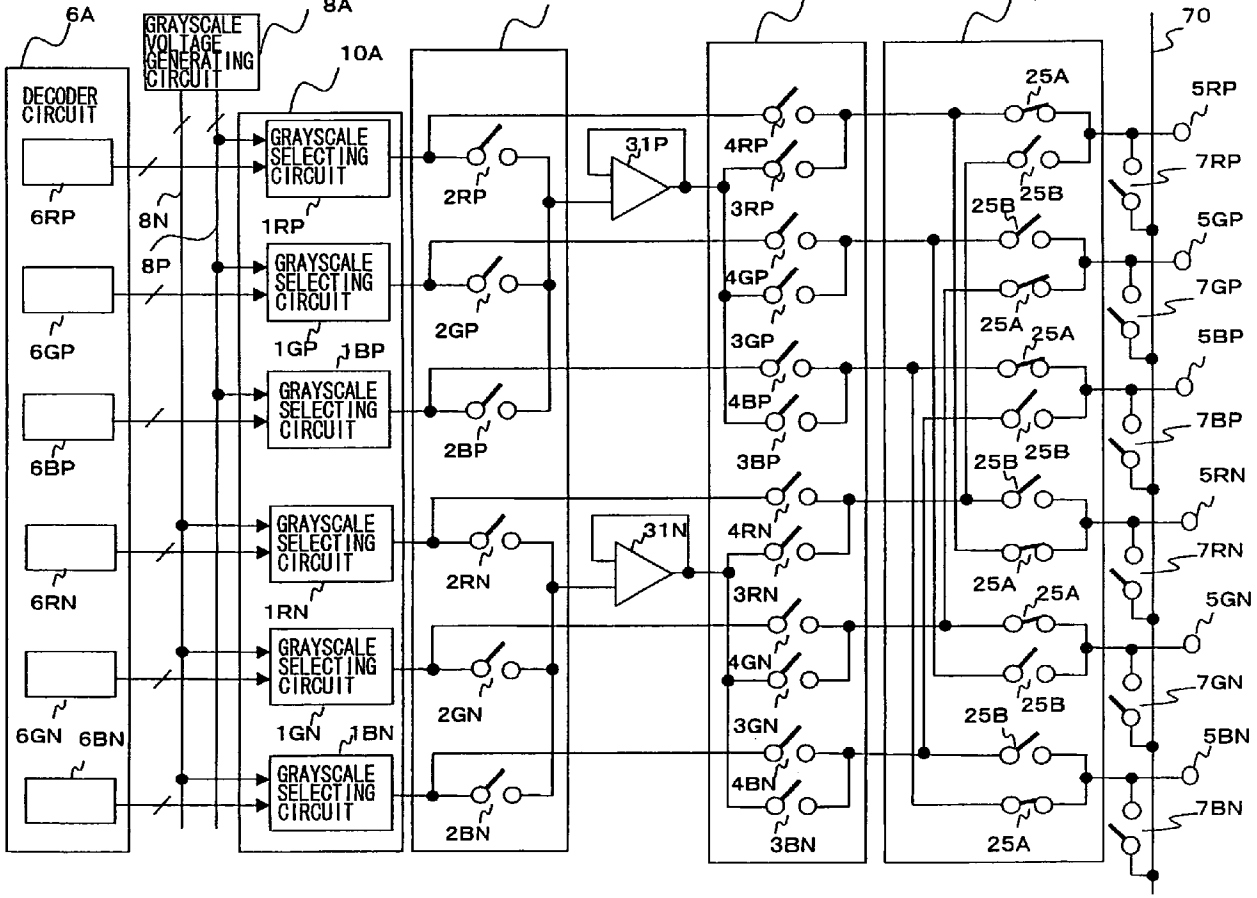
FIG. 11 is a circuit diagram of the main components of a data electrode driving circuit according to a fourth embodiment of the present invention.

FIG. 11 is a circuit diagram of the main components of a data electrode driving circuit according to the fourth embodiment of the present invention. The main points in FIG. 11 that differ, in terms of structure, from FIG. 4 in the first embodiment will be described. A grayscale voltage generating circuit 8A generates a grayscale voltage signal 8P on the positive-electrode side and a grayscale voltage signal 8N on the negative-electrode side. A decoder circuit 6A includes decoder circuits 6RP, 6GP, 6BP on the side of the positive electrode and decoder circuits 6RN, 6GN, 6BN on the side of the negative electrode. A grayscale selecting circuit 10A is equipped with grayscale selecting circuits 1RP, 1GP, 1BP for selecting the grayscale voltage signal 8P on the side of the positive electrode and grayscale selecting circuits 1RN, 1GN, 1BN for selecting the grayscale voltage signal 8N on the side of the negative electrode. Also provided are a voltage follower 31P for outputting a voltage on the positive-electrode side and a voltage follower 31N for outputting a voltage on the negative-electrode side. An electrode group 25 includes six switches 25A and six switches 25B that operate in accordance with a polarity signal POL. Further provided are switches 7RP, 7GP, 7BP, 7RN, 7GN, 7BN for shorting the data electrodes in a manner similar to that described in the second embodiment. One end of each of these switches is connected to the wiring 70.

Operation will be described next. First, in order to perform drive to achieve R1 (+), G1 (−), B1 (+), R2 (−), G2 (+), B2 (−), as shown in FIG. 10, when the polarity signal POL is at the "H" level, the switches 2RP, 2GP, 2BP, 2RN, 2GN, 2BN, 3RP, 3GP, 3BP, 3RN, 3GN, 3BN, 4RP, 4GP, 4BP, 4RN, 4GN, 4BN are turned off and the switches 7RP, 7GP, 7BP, 7RN, 7GN, 7BN are turned on in the interval in which the latch signal STB is at the "H" level, thereby initializing the data electrodes 5RP, 5GP, 5BP, 5RN, 5GN, 5BN.

Next, when the latch signal STB is changed over to the "L" level, the switches 7RP, 7GP, 7BP, 7RN, 7GN, 7BN are turned off, the six switches 25A are turned on and the six switches 25B are turned off (this is the state illustrated in FIG. 11). Thereafter, in a manner similar to that of the first embodiment, each switch in the switch groups 21A and 21B is changed over and the data electrodes 5RP, 5GP, 5BP, 5RN, 5GN, 5BN are driven in time-division fashion by the voltage follower circuits 31P, 31N and grayscale selecting circuits 1RP, 1GP, 1BP, 1RN, 1GN, 1BN.

Next, in order to perform drive to achieve R1 (−), G1 (+), B1 (−), R2 (+), G2 (−), B2 (+), when the polarity signal POL is at the "L" level, the switches 2RP, 2GP, 2BP, 2RN, 2GN, 2BN, 3RP, 3GP, 3BP, 3RN, 3GN, 3BN, 4RP, 4GP, 4BP, 4RN, 4GN, 4BN are turned off and the switches 7RP, 7GP, 7BP, 7RN, 7GN, 7BN are turned on in the interval in which the latch signal STB is at the "H" level, thereby initializing the data electrodes 5RP, 5GP, 5BP, 5RN, 5GN, 5BN.

Next, when the latch signal STB is changed over to the "L" level, the switches 7RP, 7GP, 7BP, 7RN, 7GN, 7BN are turned off, the six switches 25B are turned on and the six switches 25A are turned off. Thereafter, in a manner similar to that of the first embodiment, each switch in the switch groups 21A and 21B is changed over and the data electrodes 5RP, 5GP, 5BP, 5RN, 5GN, 5BN are driven in time-division fashion by the voltage follower circuits 31P, 31N and grayscale selecting circuits 1RP, 1GP, 1BP, 1RN, 1GN, 1BN.

Thus, by driving the electrodes 5RP and 5RN, the electrodes 5GP and 5GN and the electrodes 5BP and 5BN at mutually different polarities simultaneously, migration of electric charge at the common electrodes of the liquid crystal can be minimized, thereby making it possible to obtain a high-quality display.

Figure 12:
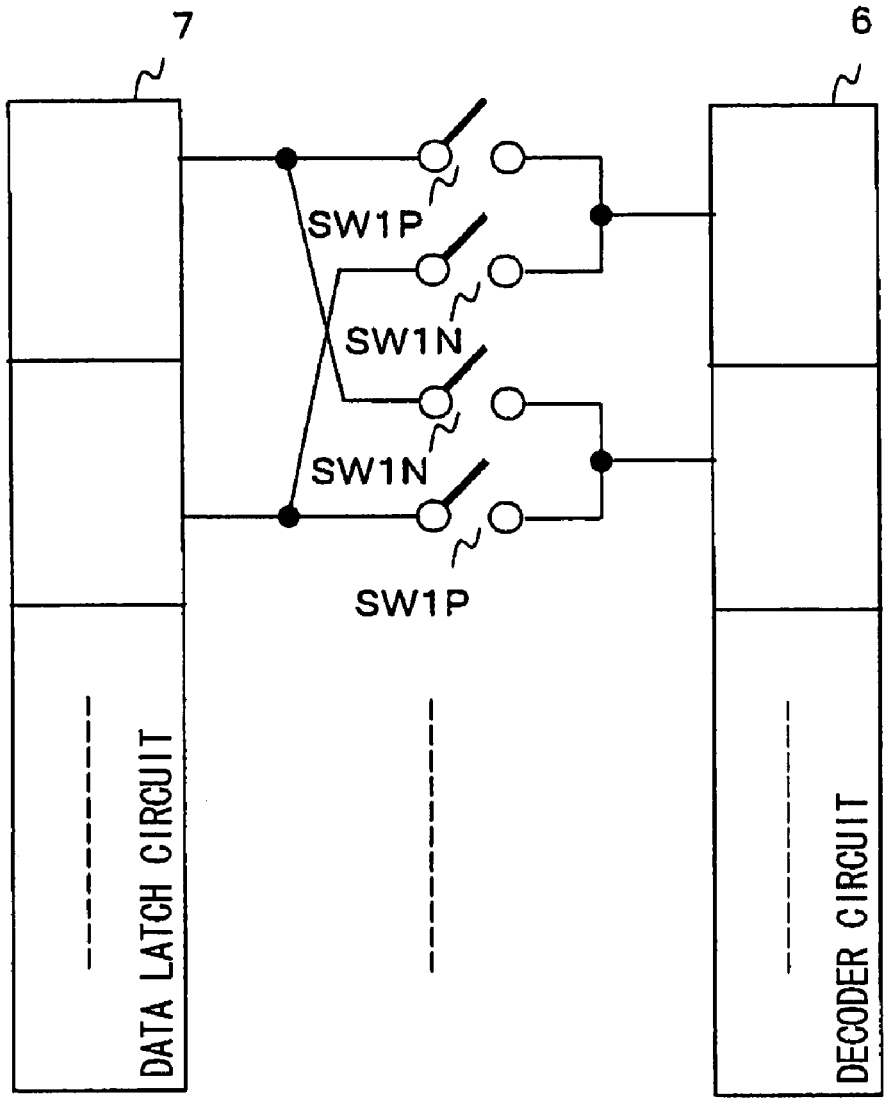
FIG. 12 is a circuit diagram illustrating an example of data interchange according to the fourth embodiment.

In order to drive the data electrodes by dedicated driver circuits of the positive and negative electrodes, interchanging of the image signals is required. FIG. 12 is a circuit diagram illustrating an example of data interchange according to the fourth embodiment. In FIG. 12, the output of the data latch circuit 7 is provided with switches SW1P, SW1N that are changed over by the polarity signal POL, whereby the image signals that are output from the data latch circuit 7 are interchanged and input to the decoder circuit 6.

Figure 13:
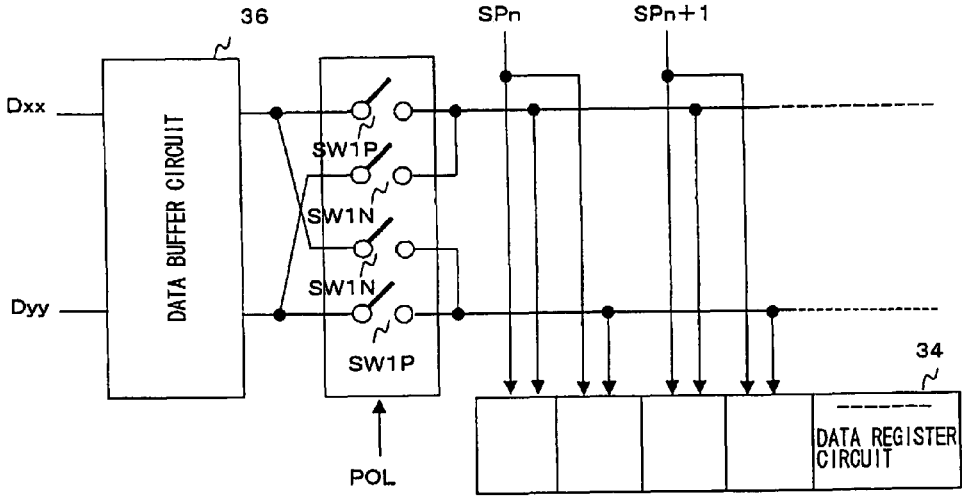
FIG. 13 is a circuit diagram illustrating another example of data interchange according to the fourth embodiment.

FIG. 13 is a circuit diagram illustrating another example of data interchange according to the fourth embodiment. In FIG. 13, the output of the data latch circuit 36 is provided with the switches SW1P, SW1N that are changed over by the polarity signal POL, whereby the image signals that are output from the data latch circuit 36 are interchanged and input to the decoder circuit 6. In this case, however, an even number of data buses is required. Another example of an interchanging method is to interchange sampling signals SPn, SPn+1. It will suffice if the data latch circuit 7 in FIG. 3 is replaced by a shift register circuit and the sampling signals are interchanged by switches. Furthermore, interchanging of the image data may be performed on the side of the CPU, etc., to which the data is transferred.

When data electrodes are driven by different voltage follower circuits, a difference between offset voltages has an effect because the offset voltages of the voltage follower circuits of the positive and negative electrodes generally differ. However, since the data electrodes are driven directly by the grayscale selecting circuit 10A, it is possible to correct for the offset voltages.

Figure 14:
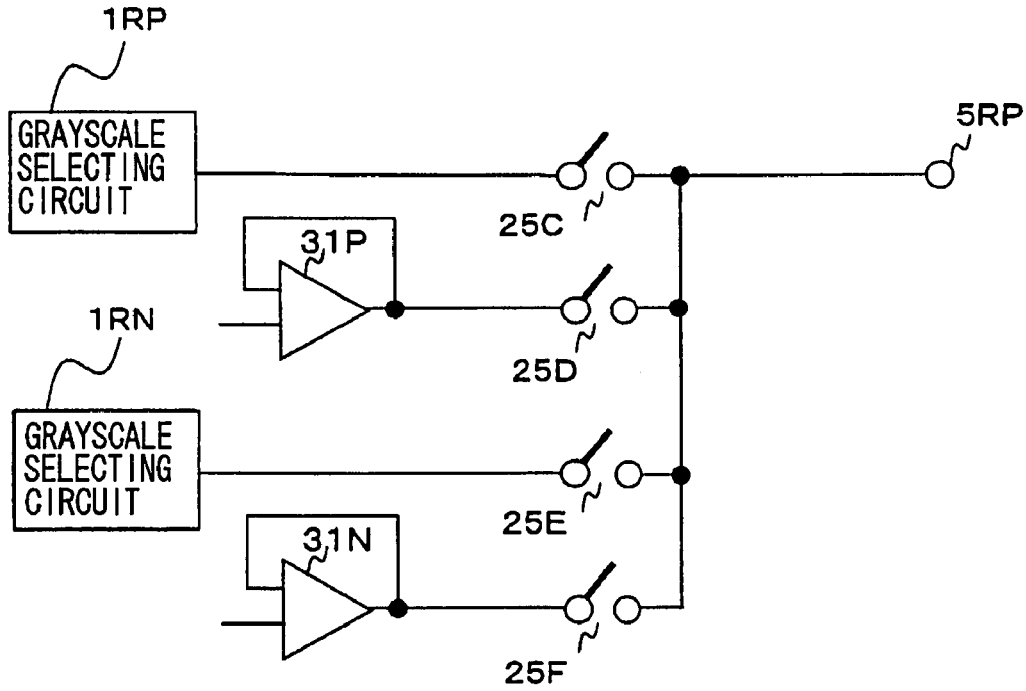
FIG. 14 is a diagram illustrating an example of a switch arrangement in an output stage according to the fourth embodiment.

In FIG. 11, pairs of switches in the switch groups 24A and 25 are connected in series. However, it is also possible to adopt an arrangement in which single switches are connected. FIG. 14 is a circuit diagram illustrating an example of a switch arrangement in an output stage according to the fourth embodiment. In FIG. 14, only the circuitry associated with data electrode 5RP is extracted and illustrated. The circuitry associated with the other data electrodes is similarly arranged.

When drive on the side of the positive electrode is performed, the switch 25D is turned on to thereby drive the data electrode 5RP by the voltage follower circuit 31P. Upon elapse of a prescribed period of time, the switch 25D is turned off and the switch 25C is turned on, thereby driving the data electrode 5RP directly by the grayscale selecting circuit 1RP.

When drive on the side of the negative electrode is performed, the switch 25F is turned on to thereby drive the data electrode 5RP by the voltage follower circuit 31N. Upon elapse of a prescribed period of time, the switch 25F is turned off and the switch 25E is turned on, thereby driving the data electrode 5RP directly by the grayscale selecting circuit 1RN.

Thus, by providing a single stage of switches that follow the voltage follower circuit, driving time can be hastened by lowering the output impedance.

In the arrangement of FIG. 11, the grayscale selecting circuits 1RP, 1GP, 1BP receive voltage on the positive-electrode side and therefore analog switches that employ P-channel transistors can be used for the switches 2RP, 2GP, 2BP, 3RP, 3GP, 3BP, 4RP, 4GP, 4BP. Further, the grayscale selecting circuits 1RN, 1GN, 1BN receive voltage on the negative-electrode side and therefore analog switches that employ N-channel transistors can be used for the switches 2RN, 2GN, 2BN, 3RN, 3GN, 3BN, 4RN, 4GN, 4BN. By adopting such an arrangement, the size of the circuitry can be reduced in comparison with transfer switches, which employ both P-channel and N-channel transistors.

Similarly, in the switch group 25, analog switches that employ P-channel transistors may be used for the switches connected to the switches 3RP, 3GP, 3BP and analog switches that employ N-channel transistors may be used for the switches connected to the switches 3RN, 3GN, 3BN.

Furthermore, instead of adopting the rail-to-rail arrangement for the differential stage of the voltage follower circuit, the voltage follower 31P can be made the differential input of an N-channel transistor and the voltage follower 31N can be made the differential input of a P-channel transistor. This will make it possible to reduce the scale of the circuitry.

Figure 15:
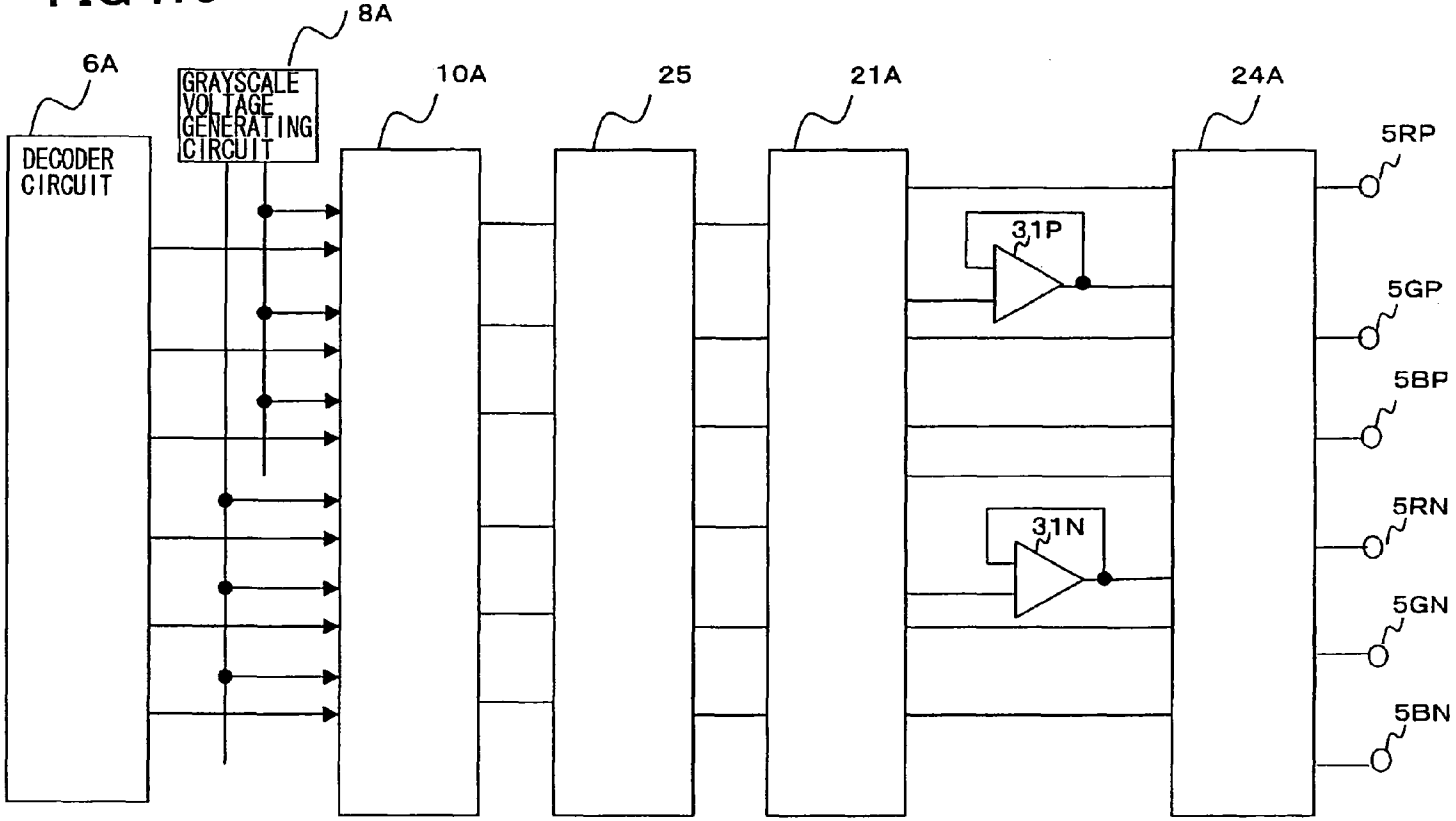
FIG. 15 is another circuit diagram of the main components of a data electrode driving circuit according to the fourth embodiment.
Figure 16:
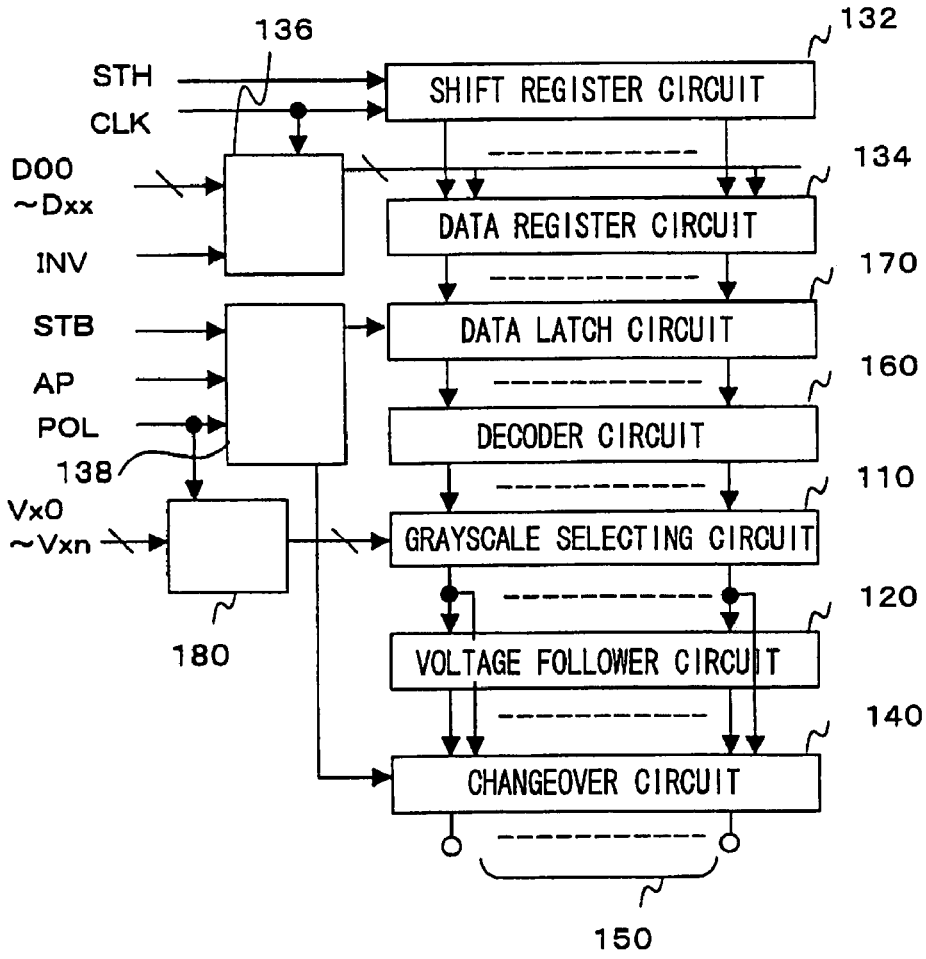
FIG . 16 PRIOR ART
FIG. 16 is a block diagram of a data electrode driver circuit according to the prior art.
Figure 18:
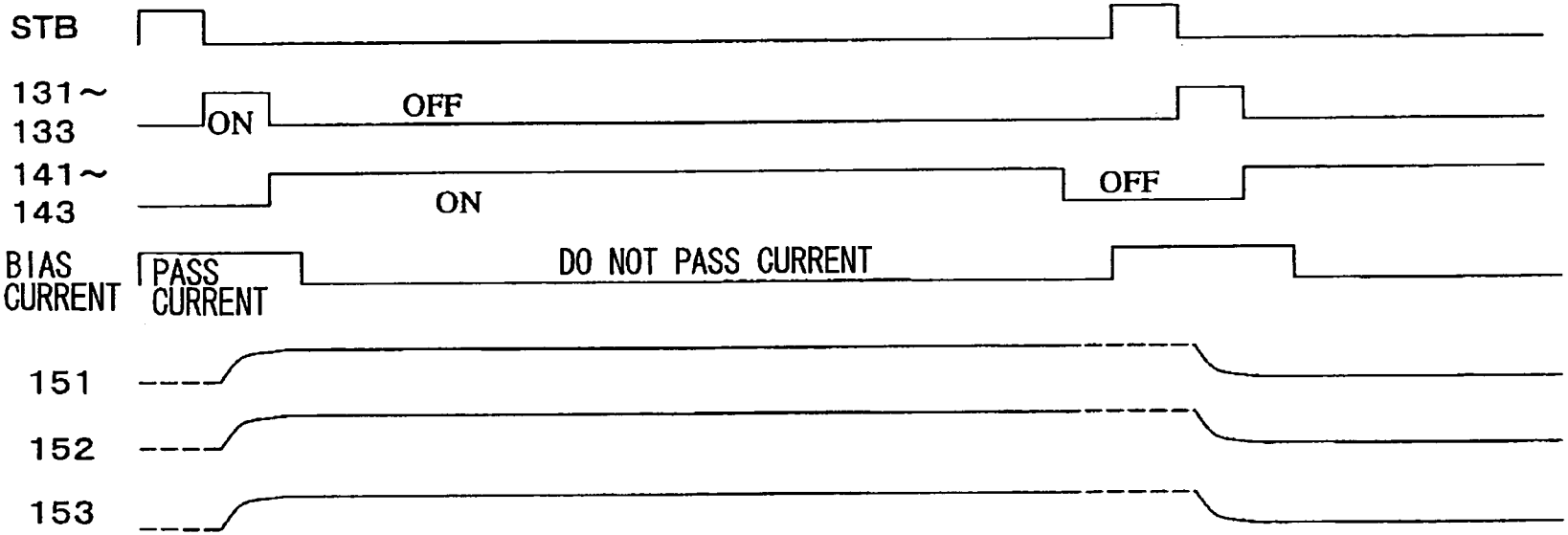
FIG. 18 PRIOR ART
FIG. 18 is a timing chart of the main components of the driver unit according to the prior art.

In FIG. 11, the switch group 25, which is changed over in accordance with the polarity signal POL, is provided between the data electrodes and the switch group 24A. However, in another feasible arrangement, the switch group 25 changed over in accordance with the polarity signal POL can be provided between the grayscale selecting circuit 10A and the switch group 21A, as illustrated in FIG. 15.

In the embodiments described above, the image signal is not limited to a 6-bit digital signal (64 grayscale levels), and a digital signal represented by five or less bits or seven or more bits may be adopted. Further, with regard to the number of image-signal data buses, it is permissible to adopt 3m (where m is a natural number) groups, such as three or six groups of RGB, and 3-line serial input may be adopted. Furthermore, the R, G, B electrodes, etc., have been described as the data electrodes for voltage drive of the display device. However, it is also permissible to adopt input electrodes of another circuit (e.g., a circuit that generates a current in driving an organic EL display).

Further, the circuit for driving the data electrodes may be provided with a frame memory or power-supply circuit. In case of a frame memory provided internally, the image signal from the CPU is asynchronous with respect to the clock of the drive system and therefore an oscillator circuit is provided to generate a clock signal. Further, the input power (Vx0 to Vxn) of the grayscale selecting circuits is capable of internally generating grayscale voltages, which conform to the gamma characteristic, from the low-order and high-order power supplies.

These circuits may be manufactured on a semiconductor integrated circuit, or some or all of the circuits may be manufactured on a glass substrate, and then applied to a display device.

The present invention make it possible to provide a display device of reduced size, low power consumption and high image quality.

As many apparently widely different embodiments of the present invention can be made without departing from the spirit and scope thereof, it is to be understood that the invention is not limited to the specific embodiments thereof except as defined in the appended claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A method of driving a display device having pixel circuits disposed at points of intersection between a plurality of scanning electrodes provided at prescribed intervals and a plurality of data electrodes provided at prescribed intervals, said method comprising:

providing an amplifier circuit that time-divisionally drives first to Nth data electrodes by dividing one horizontal latch signal interval into at least N-number of driving intervals for providing driving signals to respective corresponding ones of the plurality of data electrodes, where N is a natural number of at least 2, wherein a time duration of at least one of said driving intervals is different from time durations of the other driving interval(s), provided that the driving intervals of first, second, (N−1)th and Nth driving intervals are set as intervals t1, t2, . . . , t(N−1) and tN, respectively.

2. The method as defined in claim 1, wherein said driving interval tN is longer than any one of the driving intervals t1 to t(N−1).

3. The method as defined in claim 1, wherein said driving interval t1 is shorter than any one of the driving intervals t2 to tN.

4. A driver circuit comprising:

a plurality of output terminals;

a plurality of output circuits less in number than said output terminals, said output circuits driving said output terminals, respectively, within a prescribed latch signal driving interval; and a control circuit that time-divisionally drives said output terminals by said output circuits such that said latch signal driving interval is divided into a plurality of subintervals for providing driving signals to respective corresponding ones of the plurality of output terminals, wherein at least one of said subintervals has a time duration different from time durations of the subinterval(s).

5. A driver circuit comprising:

output terminals of N-number, where N is a natural number of at least 2;

grayscale voltage selecting circuits of N-number that selects one grayscale voltage from a plurality of grayscale voltages in response to an image signal;

a given number of amplifier circuits for impedance-converting said selected one grayscale voltage to output to said output terminals within a prescribed driving interval, said given number being smaller than N; and a change-over control circuit that performs a control including:

driving said prescribed driving interval into at least (N+1) intervals;

outputting, in a K-th interval, where K=1 to N, an output of a K-th grayscale selecting circuit to said amplifier circuit which further outputs an amplified control signal to a K-th output terminal; and outputting, in a least part of the other intervals than the K-th interval, a grayscale signal selected by the K-th grayscale voltage selecting circuit directly to said output terminals.

* * * * *